US007784896B2

(12) United States Patent
Usuda et al.

(10) Patent No.: US 7,784,896 B2
(45) Date of Patent: Aug. 31, 2010

(54) LIQUID EJECTING APPARATUS

(75) Inventors: Hidenori Usuda, Matsumoto (JP); Toshio Kumagai, Shiojiri (JP); Nobuhito Takahashi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 892 days.

(21) Appl. No.: 11/625,735

(22) Filed: Jan. 22, 2007

(65) Prior Publication Data

US 2007/0171249 A1 Jul. 26, 2007

(30) Foreign Application Priority Data

Jan. 23, 2006 (JP) ..... 2006-013602

(51) Int. Cl.
*B41J 29/393* (2006.01)

(52) U.S. Cl. ..... 347/19

(58) Field of Classification Search ..... None
See application file for complete search history.

(56) References Cited

FOREIGN PATENT DOCUMENTS

| | | | |
|---|---|---|---|
| JP | 2001-130023 | | 5/2001 |
| JP | 2001-219574 | | 8/2001 |
| JP | 2003-063035 | | 3/2003 |
| JP | 2003063035 A | * | 3/2003 |
| JP | 2003-165231 | | 6/2003 |
| JP | 2003-220798 | | 8/2003 |
| JP | 2005-088307 | | 1/2007 |

* cited by examiner

*Primary Examiner*—Stephen D Meier
*Assistant Examiner*—Alexander C Witkowski
(74) *Attorney, Agent, or Firm*—Workman Nydegger

(57) ABSTRACT

A liquid ejecting apparatus including an ejecting head that ejects a liquid from at least one row of nozzles of the ejecting head to an object, a capping unit that caps a nozzle-formed surface of the ejecting head, a suction unit that suctions a space in the capping unit, a detector that, when a liquid supplied to the ejecting head is switched to a different liquid, detects a characteristic of the different liquid and/or a characteristic of the liquid ejected by the ejecting head, and a controller that performs determination of a level of the detection and control of suction of the suction unit on the basis of a result of the determination.

23 Claims, 14 Drawing Sheets

LIQUID EJECTING APPARATUS

BACKGROUND OF THE INVENTION

1. Field of the Invention

The present invention relates to liquid ejecting apparatuses. More specifically, the present invention relates to a liquid ejecting apparatus including an ink jet recording apparatus for forming dots on a recording medium by discharging ink droplets from nozzles in an manner correspondingly to print data.

2. The Relevant Technology

Ink jet recording apparatuses perform printing operations by ejecting inks onto recording paper and are known as liquid ejecting apparatuses. Currently, the ink jet recording apparatuses are used in many types of printing, including color printing since the ink jet recording apparatuses produce relatively small noise during operation and can form small dots at high density.

An ink jet recording apparatus of the above type typically includes an ink jet printing head that is supplied with inks from ink cartridges, and a paper feeding mechanism for moving a recording medium in the scanning direction of the printing head as well as in a vertical direction. The ink jet recording apparatus performs recording by discharging ink droplets onto the recording medium. The ink droplets are discharged by generating a mechanical pressure or thermal energy to the printing head, while moving the printing head on a carriage in a width direction (main scanning direction) of the recording medium. The printing head on the carriage can discharge color inks such as black ink, yellow, cyan, and magenta. The ink jet recording apparatus can perform not only text printing with black ink, but also full color printing by changing a discharge ratio of the inks.

Additionally, in order to increase print quality in color printing, current ink jet recording apparatuses may use a total of six inks including black, yellow, cyan, and magenta, as well as light cyan and light magenta. Furthermore, ink jet recording apparatuses have been developed which are capable of large volume printing using large sized paper. In order to supply the increased amount of ink required for the increased volumes, the capacities of ink cartridges for supplying inks to portions of a printing head have been enlarged. For example, an ink jet recording apparatus has been developed in which removable ink cartridges are located in cartridge holders disposed in fixed locations at both ends of the apparatus instead of being located on the carriage. The ink is supplied from the cartridge holders to the printing head through ink flow paths comprised of flexible tubes or the like.

Such ink jet recording apparatuses print by pressing inks in pressure generating chambers which are located in each printing head. The pressurized ink is discharged as ink droplets to a recording medium such as recording paper. Unfortunately, however, misprinting may occur due to an increase in ink viscosity and ink fixation, caused by evaporation of solvent from nozzle openings together with dust adhesion and the mixing of air bubbles. Accordingly, the ink jet recording apparatuses generally include a capping unit in order to prevent ink from drying by sealing the nozzle openings of the printing head when no printing is being performed.

The capping unit functions as an air sealing cover for preventing ink in the nozzle openings from drying when no printing is being performed, that is, when printing is stopped. The capping unit also functions by sealing nozzle plates when the nozzle openings clog, and by using negative pressure from a suction pump connected to the capping unit to suction ink from all the nozzle openings. Thus the capping unit is able to eliminate clogging caused by ink fixation in the nozzle openings as well as ink discharge defects caused by the mixing of ink in an ink flow path.

A "cleaning operation" is another function commonly used in ink jet apparatuses and is accomplished by applying suction force in order to exhaust excess or residual ink in order to eliminate clogging in the printing head and the mixing of air bubbles into the ink flow path. Typically, the cleaning operation is automatically executed when printing is restarted after the apparatus is stopped for a long time, and when a user manually operates a cleaning switch in order to eliminate quality deterioration.

The ink jet recording apparatus also has a "flashing operation" function comprised of discharging air droplets from all the nozzles while applying a driving signal that is unrelated to the printing head. This flashing operation is automatically executed according to a predetermined period. The flashing operation aligns irregular meniscuses in the vicinity of the nozzle openings of the printing head which may be caused by wiping or other portion of the cleaning operation. The flashing operation prevents clogging issues caused by increased ink viscosity in the nozzle openings from which less amount of ink is discharged during printing.

With in the ink jet recording apparatus, cartridges can be replaced depending on the printing purpose since the ink jet recording apparatus can perform various types of printing. More specifically, when printing needs to be performed using different inks than the colors presently loaded in the ink cartridges, the loaded cartridges may be temporarily removed, and replaced with ink cartridges containing inks of desired types. Thus, printing may easily and frequently be performed with different types of print qualities using the same printer and different types of inks.

Typically, when a type of ink is switched to a different type of ink, a washing liquid used for temporarily washing the remaining ink in a flow path is introduced into a recording head before the different type of ink is used. Additionally, in order to prevent the formation of dried ink in the nozzle opening when the apparatus is stopped, a moisturizing liquid for preventing drying is discharged into the capping unit before the capping function is performed.

Accordingly, the ability to switch between inks and functional liquids such as washing liquid or moisturizing liquid has been proposed. Unfortunately, however, immediately after a liquid cartridge is switched, a liquid of the previously loaded cartridge still remains in the ink flow path and the printing head. Thus, print quality is deteriorated after replacement. Additionally, the mixing of liquids of different types may cause problems such as an undesired chemical reaction, increased ink viscosity, and clogging. Presently, the flashing and cleaning operations currently used cannot cope with these problems.

Several technologies have been developed to solve these problems, including the apparatuses described in Japanese Patent Applications JP-A-2001-219574 and JP-A-2003-220798 which each describe an ink jet recording apparatus with a plurality of fluid supply units and a switching unit for selecting an arbitrary number of fluid supply units from among the plurality of fluid supply units, in order to prevent different types of inks from being mixed.

Although each of the described apparatuses efficiently uses a liquid switching unit, the complete switching of a liquid in a flow path still requires a certain period of time. Additionally, neither system includes a unit for confirming that the liquid in the flow path has completely been switched or a unit for confirming defective ejection immediately after liquid switching. Accordingly, there remains the possibility that a problem may occur in reliability of initial print quality immediately after liquid switching.

BRIEF SUMMARY OF THE INVENTION

One aspect of the invention is the ability to confirm the complete switching of the liquid and defective discharge immediately after liquid switching and the ability to ensure the initial ejection quality immediately after liquid switching.

Another aspect of the invention is a liquid ejecting apparatus including an ejecting head that ejects a liquid from at least one nozzle rows of the ejecting head to an object, a capping unit that caps a nozzle-formed surface of the ejecting head, a suction unit that suctions a space in the capping unit, a detector that detects a characteristic of the different liquid and/or a characteristic of the liquid ejected by the ejecting head when a liquid supplied to the ejecting head is switched to a different liquid, and a controller that performs a determination of the liquid switching level based on the result of detection by the detector and, depending on a result of the determination, controls the suction by the suction unit.

In one embodiment of the invention, when a liquid supplied to an ejecting head is switched, a characteristic of a liquid to the ejecting head and/or a characteristic of an liquid ejected from the ejecting head is detected and a liquid switching level is determined. Depending on the result of the determination, suction by the suction unit is controlled. Thus, liquid ejection to the object can be initiated after confirming that the liquid in the recording head has substantially completely been switched. This makes it possible to ensure initial ejection quality after liquid switching.

In an embodiment of the invention, when the detector detects a characteristic of a liquid in a flow path in which a liquid supplied to the ejecting head flows, the detector determines the switching level by detecting a characteristic of the liquid at a position at which the liquid is supplied to the ejecting head. Thus, liquid ejection to the object can be initiated after confirming that the liquid in the recording head has substantially completely been switched. This makes it possible to ensure initial ejection quality after liquid switching.

In an embodiment of the invention, the detector detects a characteristic of a liquid ejected from an outermost nozzle among a plurality of nozzles provided on the ejecting head. Since flow paths of nozzle rows at outer positions in the ejecting head are longer than those of nozzle rows in the center, any unswitched liquid is most likely to remain the ejecting head in the outer nozzle. Thus the liquid switching level is determined by detecting a characteristic of a liquid actually ejected from the nozzle at the outer position in order to ensure that the liquid has been completely switched. Thus, liquid ejection to the object can be initiated after confirming that the liquid in the recording head has substantially completely been switched. This makes it possible to ensure initial ejection quality after liquid switching.

According to another embodiment of the invention, when the detector detects a characteristic of a liquid ejected from a nozzle at an outermost end in each nozzle row provided on the ejecting head, since the flow path of a nozzle at the outermost end in the ejecting head is more difficult compared to the flow path in the nozzles near the center of the ejecting head. Thus, it is relatively difficult for a liquid to flow in the flow paths of the nozzles on the outermost end in each nozzle row and any residual liquid is most likely to remain in the flow paths of the outermost nozzles. Thus, the liquid switching level is determined by detecting a characteristic of a liquid actually ejected from the nozzle at the outermost end. Thus, liquid ejection to the object can be initiated after confirming that the liquid in the recording head has been adequately switched. This makes it possible to ensure initial ejection quality after liquid switching.

In one embodiment of the invention, when the detector detects a characteristic of a mark formed on an object when a liquid ejected from the ejecting head reaches the object, a liquid switching level is determined by detecting a characteristic of the mark. After confirming that the liquid in the ejecting head has been switched to such a level that the mark has no problem, liquid ejection to the object can be initiated, thus ensuring initial ejection quality after liquid switching.

The ink jet recording apparatus of the invention may further include a plurality of liquid supply units that supply liquids to the ejecting head and a switching unit that switches liquids supplied to the ejecting head by selecting an arbitrary number of liquid supply units from among the plurality of liquid supply units. When the liquid supplied to the ejecting head is switched by the switching unit, the level of liquid switching and control of suction may be monitored, thus ensuring initial ejection quality after liquid switching.

In one embodiment of the invention, when the liquid supplied to the ejecting head is switched to a recording ink by the switching unit, the control unit determines a liquid switching level and executes suction control before printing with the ink. Thus, the ejection quality may be ensured after liquid switching.

In another embodiment of the invention, when the liquid supplied to the ejecting head is switched to a functional liquid different from a recording ink, the control unit does not determine a liquid switching level or execute suction control, since an evaluation of print quality is not required after switching of the liquid to the functional liquid different from the ink. Thus, apparatus throughput can be improved and unnecessary liquid consumption can be prevented.

In another embodiment of the invention, when the control unit executes an operation of recording to the target after the liquid supplied to the ejecting head is switched by the switching unit, the control unit determines a liquid switching level and executes suction control. Thus, the initial ejection quality after liquid switching may be ensured.

In yet another embodiment of the invention, when the control unit executes a functional operation different from an operation of recording to the target after the liquid supplied to the ejecting head is switched by the switching unit, the control unit does not perform any determination of a liquid switching level or any suction control, since print quality is not evaluated. Thus, apparatus throughput can be improved and unnecessary liquid consumption can be prevented.

In another embodiment of the invention, when the liquid supplied to the ejecting head is switched by the switching unit, the control unit, in addition to determining the liquid switching level and executing suction control, performs a defective ejection detecting operation by performing trial ejection of all the nozzles in order to detect a defective nozzle ejection. When a defective nozzle is detected, the control unit executes a nozzle recovery operation, wherein the control unit ensures a recovery of the defective nozzle by depending on liquid switching by the switching unit. Thus, initial ejection quality after liquid switching may be ensured.

In another embodiment of the invention, when the liquid supplied to the ejecting head is switched to a recording ink, the control unit executes a defective ejection detecting operation, wherein the control unit performs a recovery of the defective nozzle before printing with the ink. Thus, initial ejection quality after liquid switching can be ensured.

In another embodiment of the invention, when the liquid supplied to the ejecting head is switched to a functional liquid different from a recording ink, the control unit does not perform any defective ejection detecting operation, meaning that the control unit does not perform any recovery of a nozzle defective in ejection since print quality is not evaluated after the liquid supplied to the ejecting head is switched to the functional liquid. Thus, apparatus throughput can be improved and unnecessary liquid consumption can be prevented.

In a further embodiment of the invention, when the operation of recording to the target is executed after the liquid supplied to the ejecting head has been switched by the switching unit, the control unit executes a defective ejection detecting operation, wherein the control unit performs a recovery for a nozzle defective in ejection before printing with the ink. Thus, initial ejection quality after liquid switching can be ensured.

In another embodiment of the invention, when a functional operation different from an operation of recording to the target is executed after the liquid supplied to the ejecting head is switched by the switching unit, the control unit does not execute any defective ejection detecting operation or any recovery for a nozzle defective in ejection since print quality is not evaluated. Thus, apparatus throughput can be improved and unnecessary liquid consumption can be prevented.

In another embodiment of the invention, during the determination of the liquid switching level, the control unit sets a plurality of threshold level values for a characteristic of a liquid detected by the detector, and the control unit performs control so that suction is performed in a plurality of suction mode levels depending on the threshold level values. Thus the liquid switching can be completed, while preventing any liquid consumption due to unnecessary suction.

In another embodiment of the invention when a control unit executes a defective ejection detecting operation, the control unit first determines of the liquid switching level and executes suction control, which may require a relatively large amount of liquid suction. After the liquid switching is completed, the control unit then performs a defective ejection detecting operation for the defective nozzle. Thus, the liquid switching may be performed without unnecessary liquid consumption while ensuring against recording errors.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment of an ink jet printer, used as a liquid ejecting apparatus, wherein an example of the invention is embodied is described below with reference to FIGS. 1 to 9.

Figure 1:
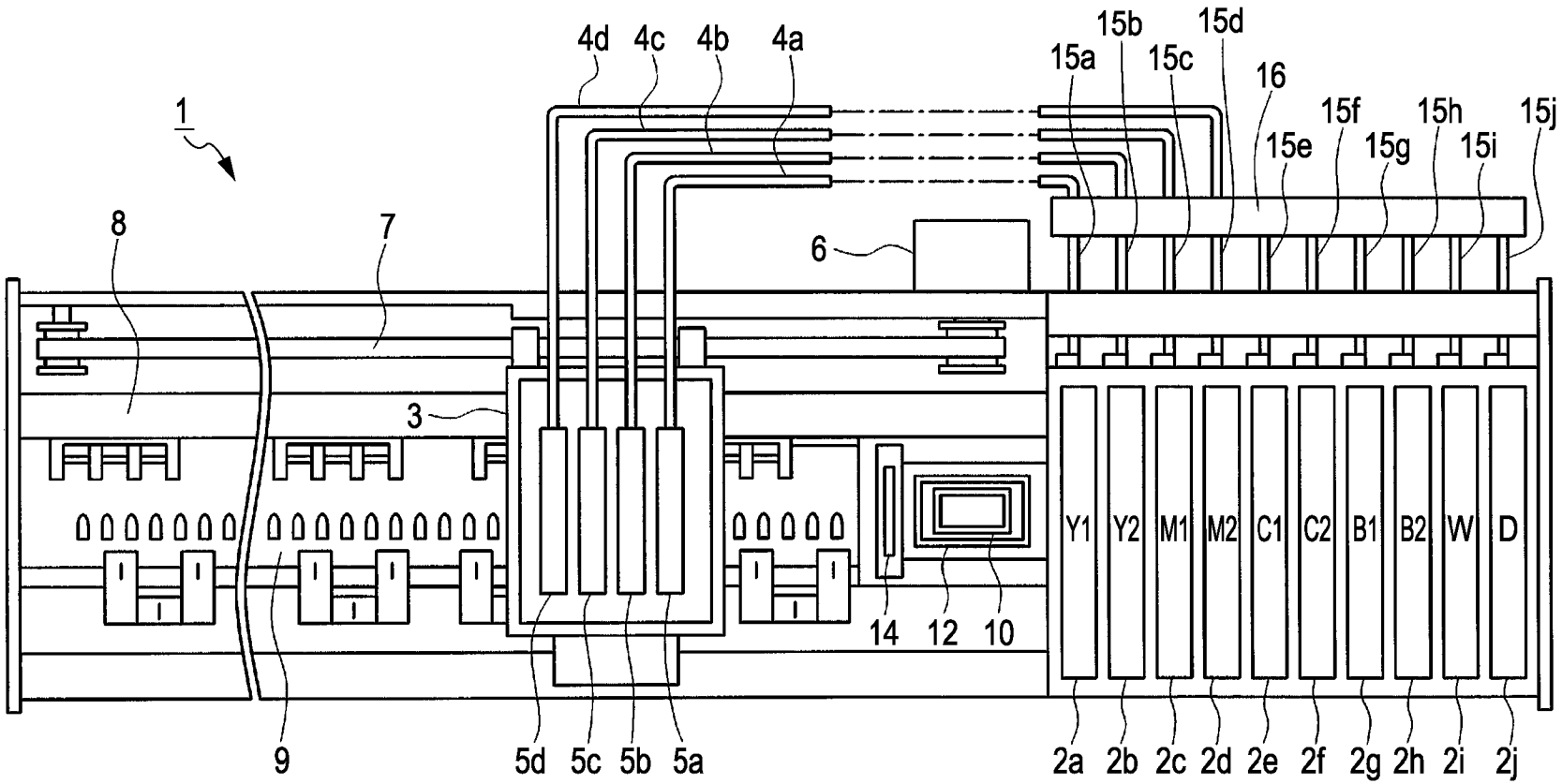
FIG. 1 is a schematic plan view of an ink jet printer main unit in a first embodiment of the invention.

FIG. 1 is a schematic plan view of an ink jet printer main unit 1 in an ink jet printer housing (not shown).

The ink jet printer main unit 1 includes a plurality of cartridges 2*a* to 2*j*, used as liquid supply units for the recording head 30 (see FIGS. 6A and 6B) which is used as an ejecting head. For the cartridges 2*a* to 2*j*, holders and guide plates (not shown) may also be provided in a nonprinting area.

The cartridges 2*a* to 2*j* correspond to the number of liquids for use. In this embodiment, ten cartridges 2*a* to 2*j* are provided. In the cartridges 2*a* to 2*j*, liquid containers (not shown) for containing the liquids are provided. The liquids in the liquid containers can be supplied to the recording head 30 through subcontainers 5*a* to 5*d*.

The cartridges 2*a* to 2*j* are linked to a switching unit 16 by cartridge tubes 15*a* to 15*j*. The switching unit 16 switches a liquid supplied to the recording head 30 by selecting an arbitrary number of cartridges from among the cartridges 2*a* to 2*j*. In this embodiment, the switching unit 16 selects four cartridges 2*a* to 2*d* from the ten cartridges 2*a* to 2*j*, and supplies the liquids in the selected cartridges to the subcontainers 5*a* to 5*d* and the recording head 30 via supply tubes 4*a* to 4*d*.

The subcontainers 5*a* to 5*d* provided in the carriage 3 correspond to the number of inks ejected from the recording head 30. In this embodiment, a total of four subcontainers 5*a* to 5*d* are provided on the carriage 3. The subcontainers 5*a* to 5*d* can supply liquids, such as the inks supplied from the supply tubes 4*a* to 4*d*, to the recording head 30, which is located on a lower surface of the carriage 3.

In this embodiment, four inks, including, yellow, magenta, cyan, and black, are typically ejected. Four supply tubes 4*a* to 4*d* and four subcontainers 5*a* to 5*d* are provided correspondingly to the four inks. The subcontainers 5*a* to 5*d* can supply inks or the like in a corresponding manner to four rows 25*a* to 25*d* of nozzles (see FIG. 10B) formed on a nozzle surface of the recording head 30.

The carriage 3 provided with the subcontainers 5*a* to 5*d* is driven by a carriage motor 6. The carriage 3 can be guided with a timing belt 7 by a scanning guide member 8 so as to move in a reciprocating manner in a longitudinal direction of a paper feed member 9, that is, in a main scanning direction that is the width direction of recording paper.

In the nonprinting area, a cap member 10 acting as a sealing unit, a suction pump 11 (see FIG. 7), and a waste fluid container 12 are located. The cap member 10 is formed from a flexible material such as rubber. When the carriage 3 moves to the nonprinting area, the cap member 10 can seal the nozzle surface of the recording head 30. Accordingly, the cap member 10 functions as a cover for preventing nozzle apertures of the recording head 30 from drying in a resting period.

A bottom surface of the cap member 10 is connected to the suction pump 11 by a tube 13. The suction pump 11 allows the recording head 30 to eject liquids by suctioning the space in the cap member 10 in order to apply a negative pressure, which is generated by the suction pump 11 on the recording head 30. In addition, located on a print area side of the cap member 10, is a wiping member 14 made of an elastic member such as rubber. The wiping member 14 is disposed so as to clean the nozzle surface of the recording head 30 by wiping the nozzle surface, if necessary.

In this embodiment, among the ten cartridges 2*a* to 2*j*, eight cartridges 2*a* to 2*h* are used to supply inks to the recording head 30. The other two cartridges 2*i* and 2*j* are functional liquid cartridges for supplying the recording head 30 with functional liquids such as cleaning liquid or moisturizing liquid.

Specifically, the cartridge 2*a* is used as an ink cartridge for a first yellow ink (Y1). The cartridge 2*b* is used as an ink cartridge for a second yellow ink (Y2). The cartridge 2*c* is used as an ink cartridge for a first magenta ink (M1). The cartridge 2*d* is used as an ink cartridge for a second magenta ink (M2). The cartridge 2*e* is used as an ink cartridge for first a cyan ink (C1). The cartridge 2*f* is used as an ink cartridge for a second cyan ink (C2). The cartridge 2*g* is used as an ink cartridge for a first black ink (B1). The cartridge 2*h* is used as an ink cartridge for a second black ink (B2).

In addition, the cartridge 2*i* may be used as a cartridge for a washing liquid (W) to be supplied when the interior of a flow path of the recording head 30 or the like is washed. The cartridge 2*j* may be used as a cartridge for a moisturizing liquid (D) to be used in order to prevent the nozzles from drying by ejecting the moisturizing liquid in the cap member 10 just before the apparatus is stopped.

Figure 2A:
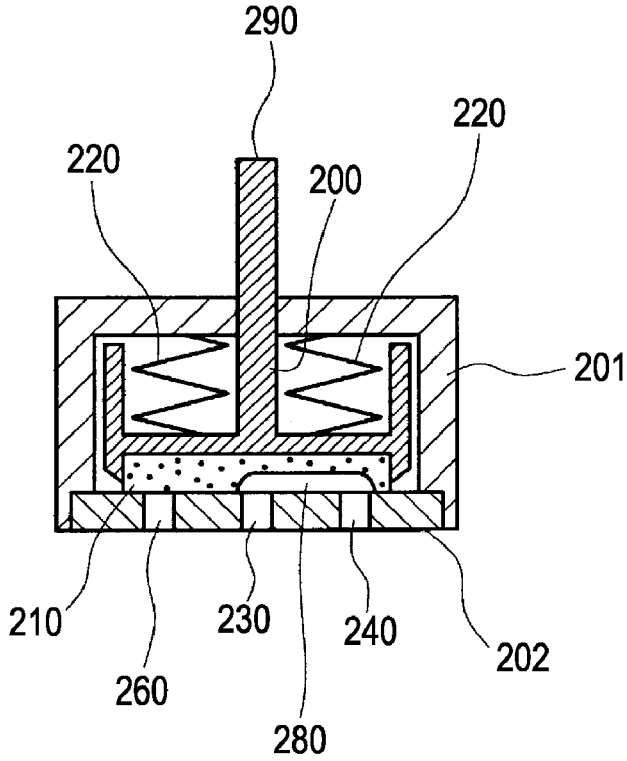
FIGS. 2A and 2B are illustrations of a switching valve.
Figure 2B:
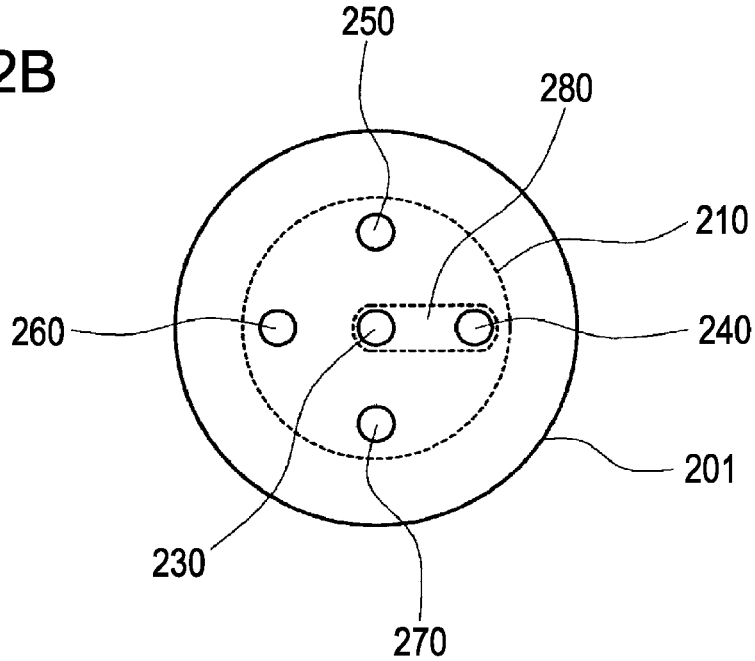

FIGS. 2A and 2B show an example of a switching valve usable as the switching unit 16.

FIG. 2A is a sectional view of the switching valve, and FIG. 2B is a front view of the switching valve. The switching valve includes a switching valve housing 201, an inlet/outlet plate 202, a valve packing holder 200, a rubber valve packing 210, and a spring 220. The valve packing holder 200 holds the rubber valve packing 210. The spring 220 is located within the switching valve housing 201, and presses the valve packing holder 200. The spring 220 holds the rubber valve packing 210 between the valve packing holder 200 and the inlet/outlet plate 202. The inlet/outlet plate 202 has an opening 230 in its center and is connected to the recording head 30 through the supply tubes 4*a* to 4*d*. Openings 240, 250, 260, and 270 are located around the opening 230 and are connected to the cartridges 2*a* to 2*j* of different types of liquids through the cartridge tubes 15*a* to 15*j*.

In the state shown in FIGS. 2A and 2B, the openings 240 and 230 are linked by a flow path 280, and the other three openings 250, 260, and 270 are not linked to the opening 230. By turning a tail 290 of the valve packing holder 200 from this state, the position of the flow path 280 changes, and the opening linked to the opening 230 connected to the recording head 30 moves from the opening 240 to the opening 250. By turning the tail 290 by 90 degrees, the opening linked to the opening 230 is changed from the opening 250 to the opening 260. By further turning the tail 290 by 90 degrees, the opening linked to the opening 230 moves from the opening 260 to the opening 270. By further turning the tail 290 by 90 degrees, the opening linked to the opening 230 moves from the opening 270 to the original opening 240. As described above, whenever the tail 290 is turned by 90 degrees, the opening linked to the recording head 30 is switched from the opening 240 to the opening 250, from the opening 250 to the opening 260, from the opening 260 to the opening 270, and from the opening 270 to the opening 240. In this manner, liquids to be supplied to the recording head 30 can be switched.

This embodiment includes four switching valves as described in FIGS. 2A and 2B, each corresponding to the colors of inks ejected. The openings 230 of the four switching valves are connected to the supply tubes 4*a* to 4*d*, respectively.

In addition, the openings 240, 250, 260, and 270 of the four switching valves are connected to the cartridges 2*a* to 2*j* of different types of liquids by the cartridge tubes 15*a* to 15*j*.

For example, in a switching valve corresponding to yellow ink, the openings 240 and 250 are linked to the cartridge 2*a* for the first yellow ink (Y1) and the cartridge 2*b* for the second yellow ink (Y2), respectively. The openings 260 and 270 are linked to the cartridge 2*i* for the washing liquid (W) and the cartridge 2*j* for the moisturizing liquid (D), respectively.

Similarly, in a switch valve corresponding to magenta ink, the openings 240 and 250 are linked to the cartridge 2*c* for the first magenta ink (M1) and the cartridge 2*d* for the second magenta ink (M2), respectively. The openings 260 and 270 are linked to the cartridge 2*i* for the washing liquid (W) and the cartridge 2*j* for the moisturizing liquid (D), respectively.

In addition, in a switching valve corresponding to cyan ink, the openings 240 and 250 are linked to the cartridge 2*e* for first cyan ink (C1) and the cartridge 2*f* for the second cyan ink (C2), respectively. The openings 260 and 270 are linked to the cartridge 2*i* for the washing liquid (W) and the cartridge 2*j* for the moisturizing liquid (D), respectively.

In addition, in a switching valve corresponding to black ink, the openings 240 and 250 are linked to the cartridge 2*g* for the first black ink (B1) and the cartridge 2*h* for the second black ink (B2), respectively, and the openings 260 and 270 are linked to the cartridge 2*i* for the washing liquid (W) and the cartridge 2*j* for the moisturizing liquid (D), respectively.

This configuration makes it possible to supply, in a switching manner, the first yellow ink (Y1), the second yellow ink (Y2), the washing liquid (W), and the moisturizing liquid (D) to, for example, the nozzle row 25*a* corresponding to the supply tube 4*a* and the subcontainer 5*a*. This configuration also makes it possible to supply, in a switching manner, the first magenta ink (M1), the second magenta ink (M2), the washing liquid (W), and the moisturizing liquid (D) to a nozzle row 25*b* corresponding to the supply tube 4*b* and the subcontainer 5*b*. In addition, the nozzle row 25*c* corresponding to the supply tube 4*c* and the subcontainer 5*c* can be supplied with the first cyan ink (C1), the second cyan ink (C2), the washing liquid (W), and the moisturizing liquid (D). The nozzle row 25*d* corresponding to the supply tube 4*d* and the subcontainer 5*d* can be supplied with the first black ink (B1), the second black ink (B2), the washing liquid (W), and the moisturizing liquid (D).

In the above manner, the first ink (Y1, M1, C1, or B1) and the second ink (Y2, M2, C2, or B2) can both be used depending on required print quality and a type of recording paper for use. For example, dye ink and pigment ink can be switched for use. In addition, in the situation where different types of inks are switched and the different types of inks mix in the flow path 280 and in the recording head 30 and cause a problem, by temporarily switching to the washing liquid (W), the remaining inks in the recording head 30 and in the flow path 280 may be discharged for washing. This makes it possible to use many types of inks while using the same print head without increasing the number of nozzles.

Immediately before the apparatus is stopped, by switching to the moisturizing liquid (D) to eject the moisturizing liquid (D) in the cap member 10, and performing capping in a moist state, the nozzles can be prevented from drying while the apparatus is stopped.

The switching unit 16 may be an electromagnetic valve using electromagnetic force. Within the ink jet printer main unit 1, the switching unit 16 is separately illustrated for ease of understanding. However, the switching unit 16 does not always need to be separately located but may be combined within the recording head 30, and may also be located within the cartridges 2*a* to 2*j*.

Figure 3:
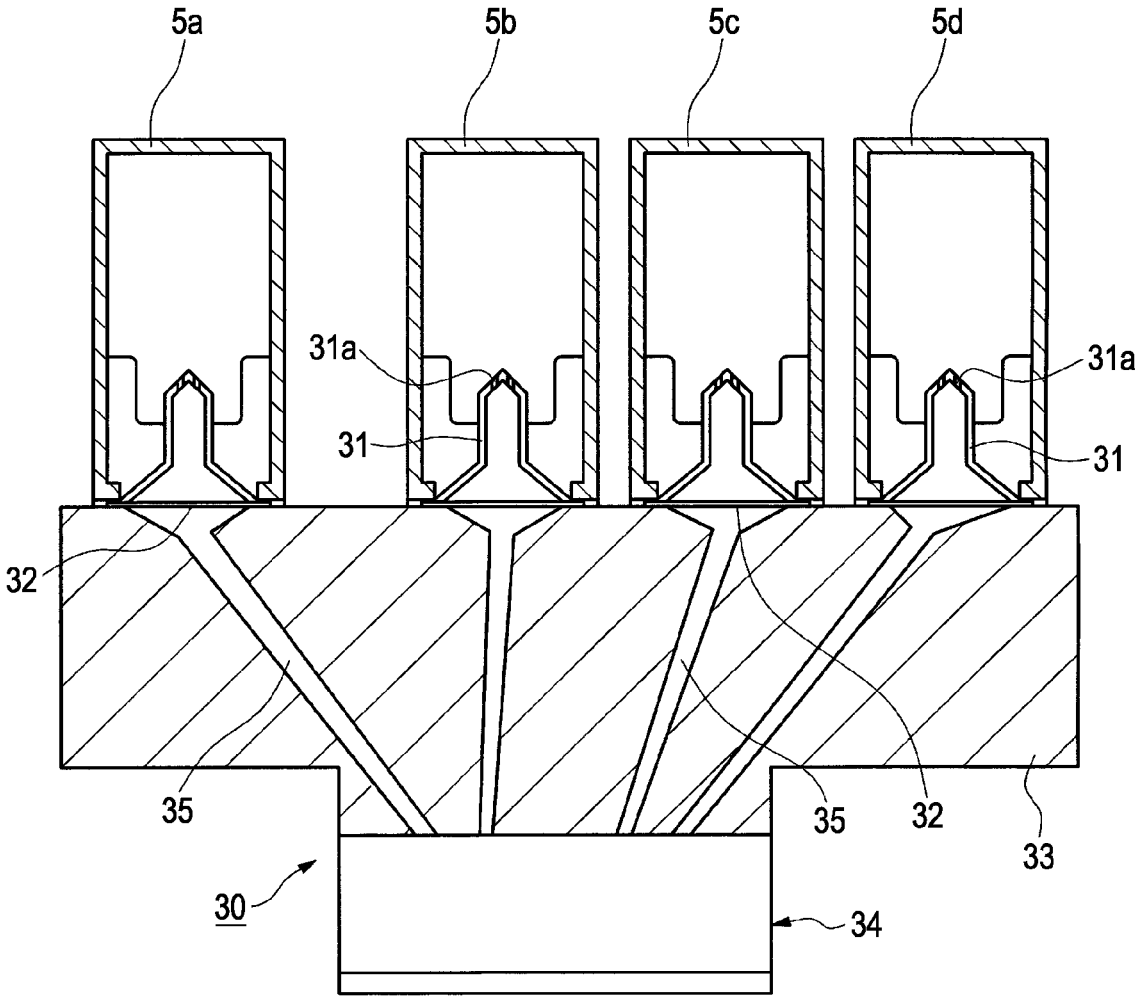
FIG. 3 is a sectional view of a recording-head flow-path structure.

FIG. 3 is a sectional view showing the recording head 30 provided on the carriage 3 for ejecting liquid ink together with the subcontainers 5*a* to 5*d* which are mounted on an upper surface of the recording head 30.

The recording head 30 also includes a filter case 33 provided with filters 32 for filtering the liquids to be ejected and a head main portion 34 provided on a lower surface of the filter case 33.

Four hollow ink supply needles 31 are uprightly disposed on an upper surface of the filter case 33. Connecting ink flow paths 35 formed in the filter case 33 are linked to ink flow paths in the ink supply needles 31. Each ink supply needle 31 has an ink introduction hole 31*a* formed at a top. Inks from the subcontainers 5*a* to 5*d* are introduced into the ink supply needles 31 through the ink introduction holes 31*a*, and are supplied to the head main portion 34 through the connecting ink flow paths 35. The supplied inks are ejected from nozzle openings of the nozzle rows 25*a* to 25*d*, shown in FIG. 11. Accordingly, the subcontainers 5*a* to 5*d*, the ink supply needles 31, and the connecting ink flow paths 35 correspond to the nozzle rows 25*a* to 25*d*.

The ink supply needles 31 are disposed at predetermined intervals corresponding to the arrangement of the subcontainers 5*a* to 5*d*. Since the width dimension of the head main portion 34 for receiving the supplied inks is smaller than a dimension occupied by the subcontainers 5*a* to 5*d*, the connecting ink flow path 35 for the ink supply located at the outer position has a larger angle of inclination then an ink supply located toward the center position. Consequently, the nozzle rows 25*a* and 25*d*, which are provided on an outer side are more likely to contain residual liquid than the nozzle rows 25*b* and 25*c* provided on the inner side.

Figure 4:
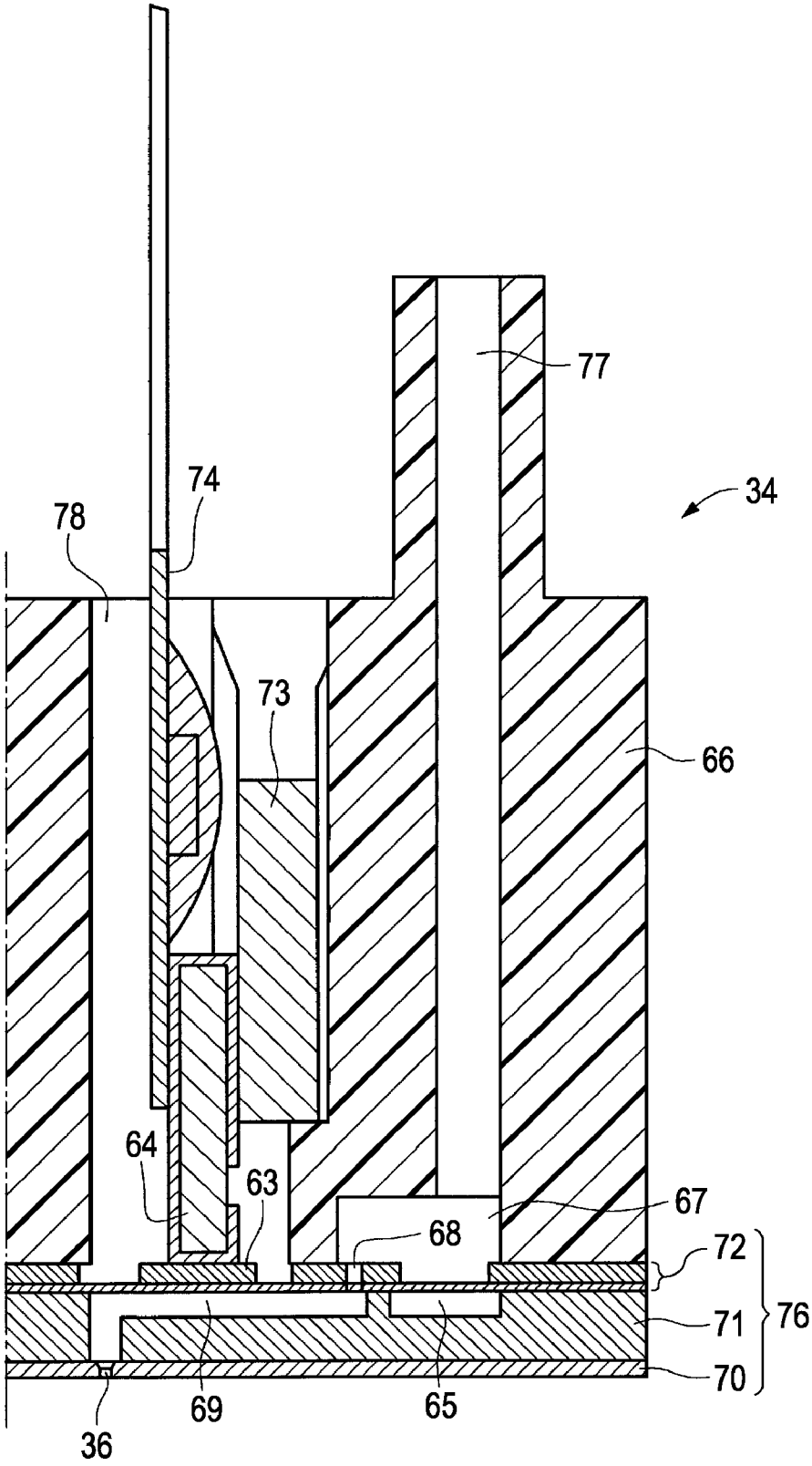
FIG. 4 is a partial sectional view of the ink jet printer main unit shown in FIG. 1.

FIG. 4 shows the head main portion 34, which includes a head case 66 capable of accommodating piezoelectric vibrators 64 which are used as pressure generators, and a flow path unit 76 fixed to a unit-fixed surface of the head case 66 by an adhesive or the like. FIG. 4 illustrates an exemplary ink ejecting mechanism corresponding to a set of nozzle rows 25*a* to 25*d*, as shown in FIG. 11, thus the head main portion 34 includes four ink ejecting mechanisms correspondingly to four sets of nozzle rows 25*a* to 25*d*.

The flow path unit 76 is formed by laminating a flow path forming substrate 71 in which flow path space including pressure generating chambers 69 is formed, a nozzle plate 70 laminated on one surface of the flow path forming substrate 71 and having therein nozzles 36 for ejecting ink in the pressure generating chambers 69, and a diaphragm (sealing plate) 72, laminated on the other surface of the flow path forming substrate 71, for sealing the flow path space including the pressure generating chambers 69.

On the nozzle plate 70, the nozzles 36 are arranged at pitch P corresponding to a predetermined resolution (dot pitch) to form a set of nozzle rows 25*a* to 25*d*, from which nozzles 36 can eject ink droplets. The nozzle plate 70 is formed of a stainless plate.

The pressure generating chambers 69, which are linked to the nozzles 36, are located within the flow path forming substrate 71. In addition, a damper chamber 65 for letting off a change in pressure in an ink storage 67, which is described later is also located within the flow path forming substrate 71. The spaces that are used as the pressure generating chambers 69 and the damper chamber 65 are formed as recesses in the diaphragm 72 on the flow path forming substrate 71. The flow path forming substrate 71 is formed in this example by etching a silicon monocrystal substrate.

The diaphragm 72 is formed of a polyphenylene sulfide film and is formed by laminating an insular part 63 or the like made of a stainless plate. In addition, the diaphragm 72 has therein an ink supply port 68 for supplying ink in the ink storage 67 to each pressure generating chamber 69.

The nozzle plate 70 is laminated on one surface of the flow path forming substrate 71, and the diaphragm 72 is laminated so that the insular part 63 is located outside, whereby the flow path unit 76 is formed. The flow path unit 76 is formed by applying adhesives on the flow path forming substrate 71, the nozzle plate 70, and the diaphragm 72, keeping them heated at a predetermined temperature, and boding them before cooling them to a room temperature The head case 66 is formed by injection-molding a thermosetting resin or thermoplastic resin. The ink storage 67, which is common to the pressure generating chambers 69, and which stores ink to be supplied to each pressure generating chamber 69, is disposed along a row of the pressure generating chambers 69 On the unit-fixed surface of the head case 66. The head case 66 also has an ink supply path 77 formed therein for supplying ink to the ink storage 67, with the ink supply path 77 being linked to the connecting ink flow path 35.

In the head case 66, an accommodating space 78 is formed extending in the direction of the nozzle rows 25*a* to 25*d* and vertically penetrating the head case 66. The accommodating space 78 can accommodate a vibrator unit 75.

The vibrator unit 75 is formed by fixing the piezoelectric vibrators 64, which are rod-shaped and provided in a row correspondingly to the pressure generating chambers 69, at an end of a fixing plate 73, and connecting a flexible cable 74 to each piezoelectric vibrator 64, for inputting a discharge signal. According to one embodiment, the piezoelectric vibrators 64 are length-extension mode vibrators.

The head main portion 34 is formed by fixing end surfaces of the piezoelectric vibrators 64 to the insular part 63 on the diaphragm 72, with the diaphragm 72 of the flow path unit 76 bonded to the unit-fixed surface of the head case 66 with an adhesive, and fixing the fixing plate 73 to the head case 66 with an adhesive.

In the head main portion 34, the piezoelectric vibrators 64 can be longitudinally expanded and contracted by inputting driving signals generated by a driving circuit to the piezoelectric vibrators 64 through the flexible cable 74. By using the expansion and contraction of the piezoelectric vibrators 64 to allow the insular part 63 on the diaphragm 72 to vibrate to change the pressures in the pressure generating chambers 69, the inks in the pressure generating chambers 69 can be discharged as ink droplets from the nozzles 36.

In the head main portion 34, the above-described ink discharge structure is used for each set of inks for four colors, that is, yellow (Y), magenta (M), cyan (C), and black (B). The inks for the colors yellow (Y), magenta (M), cyan (C), and black (B) can be discharged from the four nozzle rows 25*a* to 25*d*.

As previously described, within this structure, in the end nozzles among the nozzles 36 constituting the nozzle rows 25*a* to 25*d*, are more likely to contain residual liquids.

Figure 5A:
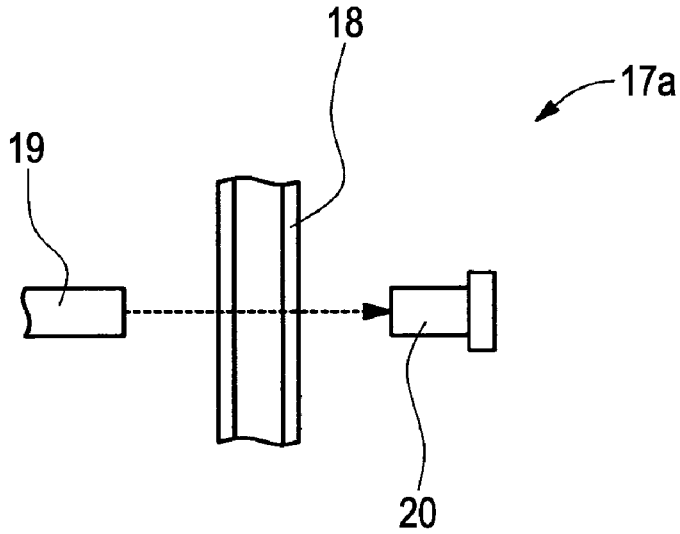
FIGS. 5A and 5B are illustrations of a detector.
Figure 5B:
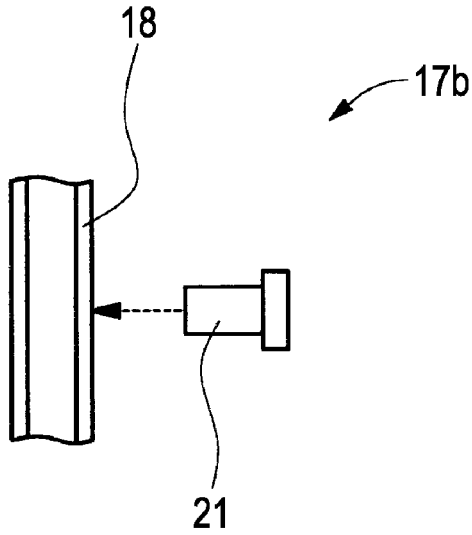

FIGS. 5A and 5B show specific examples of a detector 17 useful in determining a liquid switching level. This embodiment includes a detector 17, which, when the liquid supplied to the recording head 30 is switched, detects a characteristic of a liquid supplied to the recording head 30. This embodiment also contains a controller for determining a liquid switching level, using the result of the detection by the detector 17. The controller controls the suction of the suction pump 11 on the basis of the result of the determination.

The detector 17*a* shown in FIG. 5A detects a characteristic of a liquid flowing in a supply flow path 18 in which the liquid flows. The detector 17*a* shown in FIG. 5A is a transmissive sensor. In the transmissive sensor, an emitting element 19 and a receiving element 20 are placed opposing each other, with the supply flow path 18, generally comprised of a transparent pipe, provided there between. Radiation by the light-emitting element 19 is allowed to pass through the liquid in the supply flow path 18 and is received by the light-receiving element 20. A characteristic of the received radiation is detected. Based on the characteristic value obtained by the detection when the liquid supplied to the recording head 30 is switched, the detector 17*a* determines a switching level indicating how much the liquid in the supply flow path 18 has been switched.

By way of example, the detector 17*a*, may be a nondispersive infrared absorption sensor, an infrared pulse transmitted light sensor, or the like. The nondispersive infrared absorption sensor uses infrared radiation in the entire wavelength range radiated from a radiation source in unchanged form. By using a property of a liquid in which the liquid absorbs a unique infrared radiation wavelength range, the nondispersive infrared absorption sensor determines a liquid switching level by detecting how much the wavelength range is absorbed by a liquid when infrared radiation is emitted to the liquid. The infrared pulse transmitted light sensor is a transmitted light sensor in which a receiving element directly receives radiation from an infrared light-emitting diode. The infrared pulse transmitted light sensor determines a liquid switching level by calculating the absorbance (=log(Po/Px)), where Po represents the intensity of incident radiation, and Px represents the intensity of transmitted radiation.

The detector 17*b* shown in FIG. 5B detects a characteristic of the liquid in the supply flow path 18 in which the liquid flows. Within the detector 17*b*, a color CCD (charge-coupled device) sensor 21 is provided for detecting a color characteristic of the liquid in the supply flow path 18. Based on color characteristic values (obtained by the detection) representing 0 to 255 levels of each the red, green, and blue values of the detected color, the detector 17*b* determines a switching level indicating how much the liquid in the supply flow path 18 has been switched.

Although the detectors 17*a* and 17*b* may be located on the supply tubes 4*a* to 4*d* for supplying liquids to the recording head 30, they may also be provided on downstream flow paths of the subcontainers 5*a* to 5*d*, and may also be provided in flow paths in the recording head 30. Additionally, only one of the detectors 17*a* and 17*b* may be used or both the detectors 17*a* and 17*b* may be used in combination.

During the switching level determination, when the liquid characteristic values detected by the detectors 17*a* and 17*b* exceed a predetermined threshold value, it can be determined that the liquid in the supply flow path 18 has been adequately switched. When the liquid characteristic values detected by the detectors 17*a* and 17*b* does not exceed the predetermined threshold value an unswitched remaining liquid in the recording head 30 can be suctioned for exhaust by using the cap member 10 to perform capping and using the suction pump 11 to perform suction and the liquid obtained after liquid switching can be supplied to the recording head 30.

By setting a plurality of threshold value levels, the amount of suction and suction time of the suction pump 11 can be controlled and changed depending on the detected level of a characteristic value. For example, the threshold value is set to have three levels represented by S0>S1>S2, and a state in which liquid has completely been switched is represented by S0. Additionally, also in a suction mode, a suction level is set to have three suction levels represented by K2>K1>K0. The suction pump 11 can be controlled so that when a detected characteristic value is less than S2, suction is performed in the strongest suction mode K2. The suction pump 11 can also be controlled so that, when the detected characteristic value is not less than S2 but less than S1, suction is performed in the second strongest suction mode K1. The suction pump 11 can also be controlled so that, when the detected characteristic value is not less than S1 but less than S0, suction is performed in the third strongest suction mode K0. Finally, when the detected characteristic value is not less than S0, the ink jet printer proceeds to a print operation without performing suction.

Figure 6A:
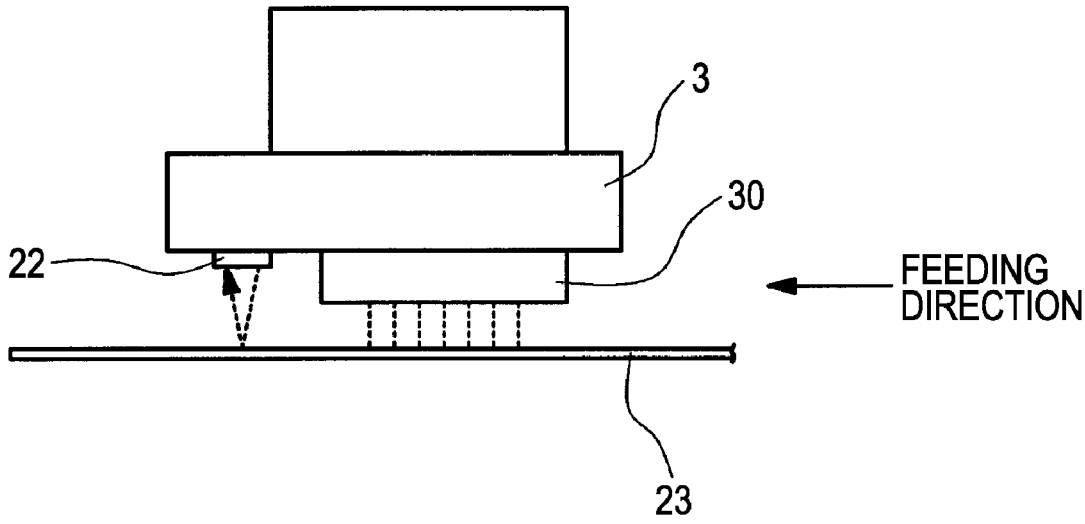
FIGS. 6A and 6B are illustrations of a missing dot detection mechanism.
Figure 6B:
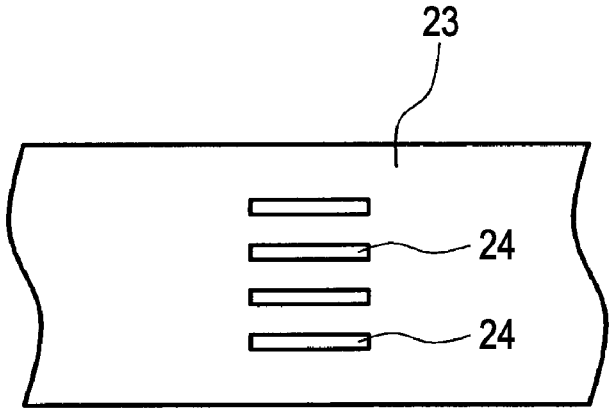

FIGS. 6A and 6B show an example of an intermittence detector 22 for use in missing dot detection. One embodiment includes a recording apparatus including a missing dot detecting mechanism. In the missing dot detecting mechanism, when the liquid supplied to the recording head 30 is switched by the switching unit 16, and the a liquid switching level and suction operations are performed, a missing dot detecting operation is executed as a defective ejection detecting operation. During the defective ejection detecting operation, any defective nozzle ejection is detected by performing trial ejection of all the nozzles. When a defective ejection is detected, a nozzle recovery operation is executed.

According to one embodiment of the missing dot detection, the first sheet of paper fed or a first part of a roll of paper is used as a trial ejection sheet, and inks are injected from all the nozzles of the recording head 30 in order to form line patterns on the trial ejection sheet so as not overlap one another. Next, the intermittence detector 22 detects whether the formed line patterns have an intermittence portion. When the formed line patterns have an intermittence portion, a recovery operation for recovering from nozzle clogging is performed.

The intermittence detector 22 is a reflected radiation detection photo-interrupter including radiation emitting and receiving elements, and is located on a surface opposing recording paper 23 on the carriage 3 located within the recording head 30.

In line pattern formation, by performing a trial ejection from the nozzle rows 25*a* to 25*d* of the recording head 30 while moving the carriage 3 above the recording paper 23 which is used as the trial ejection sheet, straight line patterns 24 may be formed on the recording paper 23. By moving the intermittence detector 22 using a paper feed mechanism (not shown) to repeat sequential transportation of the recording paper 23 for each pattern by each pattern length created in the straight line patterns 24, an intermittence portion of a straight line pattern 24, such as an intermittence portion caused by nozzle clogging, or a portion bearing no ejected ink, can be optically detected.

After detecting the intermittence portion, the cap member 10 to caps and uses the suction pump 11 to perform suction in a cleaning mode. Thus, upon the detection of an intermittence, a recovery operation performed in order to recover a clogged nozzle.

Figure 7:
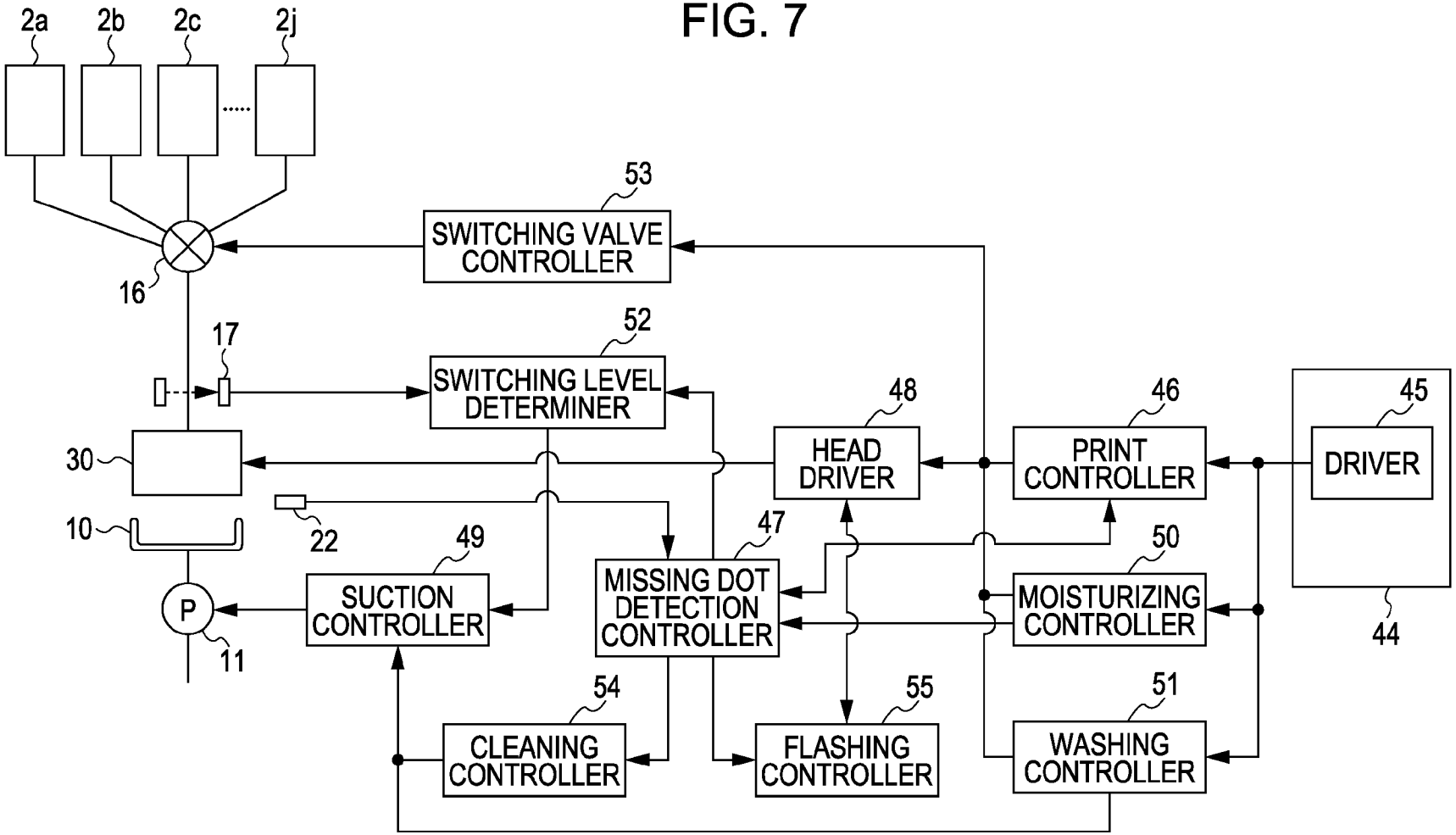
FIG. 7 is a block diagram of a system configuration.

FIG. 7 is a block diagram showing an example of the configuration of the recording apparatus. Within the recording apparatus, a print controller 46, moisturizing controller 50, washing controller 51, head driver 48, missing dot detection controller 47, cleaning controller 54, suction controller 49, switching level determiner 52, switching valve controller 53, and flashing controller 55, which are described below, function.

FIG. 7 also shows a host computer 44 having a built-in printer driver 45. By using an input device (not shown) on utilities of the driver 45, selections such as recording paper size, selection between monochrome print and color print, recording mode, font, and other printing instructions may be inputted. In addition, a liquid switching command to the switching unit 16 can be inputted in order to control the utility of the driver 45, Inputting of the print command allows the driver 45 to send print data as liquid ejection data to the print controller 46. Additionally, the print controller 46 can generate bitmap data on the basis of the print data, input driving signals generated by the head driver 48 to the piezoelectric vibrators 64, and allow the recording head 30 to discharge ink droplets. After receiving the instruction from the print controller 46, a paper feed controller (not shown) controls a paper feed motor (not shown) in order to control movement of the recording paper 23 in a sub-scanning direction. Similarly, after receiving instructions from the print controller 46, a carriage controller (not shown) controls the carriage motor 6 to control reciprocating movement of the carriage 3 in the main scanning direction.

The head driver 48 functions as a driving unit. The head driver 48 outputs not only the driving signals based on the print data, but also a driving signal for flashing to the recording head 30 in response to a flashing command signal from the flashing controller 55. The flashing operation is performed by ejecting ink unrelated to printing from a nozzle to the cap member 10, which is a flashing box, and thickened ink in the vicinity of the nozzle is discharged to recover the desired ejection characteristics in the recording head 30.

Another aspect of the present invention relates to a mechanism in which the ejection capability of a nozzle is recovered. Typically during a printing operation, the nozzle surface of the recording head 30 enters a state of release from the cap member 10, and is moved in a reciprocating manner by the carriage 3. If no ink ejection is performed in this state, the amount of evaporation of a solvent from the ink in the nozzle opening gradually increases the viscosity of the ink, ultimately causing a reduction in discharge capability. Thus, during printing a nozzle that is frequently used and results in the frequent discharge of ink droplets during the printing process, so clogs are less likely to form since the nozzle is frequently with new ink. By contrast, nozzles that are seldom used are less likely to discharge ink droplets during each printing operation and easily clog. Therefore, the more time in which no fresh ink is used and replaced in the nozzle, the more the ink viscosity increases.

In one embodiment, the liquid ejected by the recording head 30 is an ink and increased viscosity of ink results in reduced ejection capability in the nozzles. A mechanism in which the ejection capability is recovered may differ depending on the type of liquid being ejected. An embodiment of the invention is applicable to any apparatuses for ejecting ink, but may also apply to various types of liquids if the apparatuses can perform a recovery for decreased nozzle ejection characteristics by using liquid ejection.

The carriage controller performs not only movement control by moving the carriage 3 in a reciprocating manner in the main scanning direction during the printing operation, but also performs movement control for moving the recording head 30 to a flashing operation position. The flashing operation position is when the recording head 30 opposes the cap member 10 and is achieved by moving the carriage 3 with predetermined flashing timing to a flashing position in a non-printing area.

Additionally, when the power supply of the apparatus is turned off, a suction operation is performed, wherein the carriage controller performs movement control by moving the recording head 30 to the position of the cap member 10.

The suction operation is executed at the first use of the ink jet printer main unit 1. When the cartridges 2*a* to 2*j* are loaded for the first time, an initial loading operation for initially loading inks into flow paths of the recording head 30 and the subcontainers 5*a* to 5*d* is performed. Additionally, the suction operation is also executed in cases wherein the cartridges 2*a* to 2*j* are replaced, when the cartridges 2*a* to 2*j* have been used and are removed. During the replacement process, the replacement and reloading mixes air into the flow paths of the recording head 30. The mixed air makes it difficult for the recording head 30 to normally eject the liquid. Accordingly, a suction operation is executed in order to remove bubbles of the mixed air from the recording head 30 by applying forced suction.

When the ink jet printer main unit 1 is left without being used for a period of time, even in situations where the nozzle-formed surface is sealed by the cap member 10, the solvent gradually evaporates from the ink in the nozzle opening, in a manner proportional to the time the printer was left unused. Typically, the time is measured by a timer (not shown), so that when the ink viscosity increases to reduce the ejection capability a cleaning recovering is executed when the printer is in the power-on state. During the cleaning recovery process, the suction operation is executed in a cleaning mode under control of the cleaning controller 54.

In addition, when the printing operation is restored, air bubbles left in the flow paths may gradually remain in upstream in an internal filter. Accordingly, during the cleaning process, in order to remove the bubbles, suction may be performed in the cleaning mode under control of the cleaning controller 54.

When the intermittence detector 22 detects an intermittence portion of the straight line patterns 24 during previously described missing dot detection controlled by the missing dot detection controller 47 the suction operation performs a nozzle clogging recovery by performing capping by the cap member 10 and by using the suction pump 11 under the control of the cleaning controller 54 to suction.

When the number of nozzle rows 25*a* to 25*d* in which an intermittence portion or a defective nozzle exists is between one and three, then the sealing valves (not shown) provided on the subcontainers 5*a* to 5*d* are closed in the nozzle rows 25*a* to 25*d* where the error was detected. Next, liquid suction is performed on those rows, preventing unnecessary liquid consumption.

When the liquid to each of the nozzle rows 25*a* to 25*d* of the recording head 30 is switched using the switching valve controller 53 to control the switching valve, the suction operation is executed after the switching valve is switched. The suction operation is performed by using the cap member 10 to cap the nozzle-formed surface of the recording head 30 and by using the suction pump 11 to perform suction. Thus, the unswitched liquid left in the recording head 30 and the flow paths may be suctioned from the nozzle opening and the liquid obtained by liquid switching may be supplied to the recording head 30.

When the number of nozzle rows 25*a* to 25*d* to be switched is one to three, the sealing valves (not shown) provided on the subcontainers 5*a* to 5*d* corresponding to the nozzle rows 25*a* to 25*d* where the switching has not been performed are closed and liquid suction is performed only on flow paths corresponding to the switched nozzle rows 25*a* to 25*d*. This prevents any unnecessary liquid consumption.

Additionally, the switching level determiner 52 determines that the characteristic value of the liquid detected by the detector 17 has not exceeded the predetermined threshold value, a suction operation is executed. The suction operation is executed by using the cap member 10 to perform capping and using the suction pump 11 to suction the unswitched liquid left in the recording head 30. The recording head is suctioned for exhaust and the liquid obtained after liquid switching is supplied to the recording head 30.

There are cases in which suction conditions differ depending on circumstances such as an initial loading time, time of replacing the cartridges 2*a* to 2*j*, cleaning time, time of suction in the cleaning mode when a missing dot is detected, switching level determining time. Accordingly, the suction controller 49 controls a revolution speed and operating time of the suction pump 11, whereby suction is executed in a predetermined mode such as the cleaning mode, mode K1, mode K1, or mode K0.

The suction operation is controlled by the suction controller 49. During the operation, the carriage 3 is moved to a position opposing the cap member 10, and the cap member 10 is raised by working of a maintenance motor (not shown), such as a cam mechanism or the like, and the nozzle-formed surface of the recording head 30 is sealed by the cap member 10. The suction pump 11, which is driven by the maintenance motor, suctions the cap member 10, thus forcibly discharging ink or the like from the nozzle.

After suction is performed for a predetermined time, the suction pump 11 returns to an idle position wherein the exterior of the cap member 10 opened to external air by a valve mechanism (not shown) and the ink left in the space in the cap member 10 is discharged. Next, the cap member 10 is lowered. In this state, ink often adheres to the nozzle-formed surface. Thus, a wiping member 14 is used by driving the maintenance motor to raise the wiping member 14 to such a position that its end touches the nozzle-formed surface and any ink adhering to the nozzle-formed surface is wiped by the wiping member 14.

The moisturizing controller 50 switches the liquid in each of predetermined nozzle rows 25*a* to 25*d* to the moisturizing liquid (D) immediately before the apparatus is stopped by ejecting the moisturizing liquid (D) into the cap member 10 and controlling a capping operation while the cap member 10 is still moist.

When inks of different types are switched, the washing controller 51 performs temporary switching to the washing liquid (W), and controls a washing operation used to discharge the ink left in the recording head 30 or in each flow path.

Figure 8:
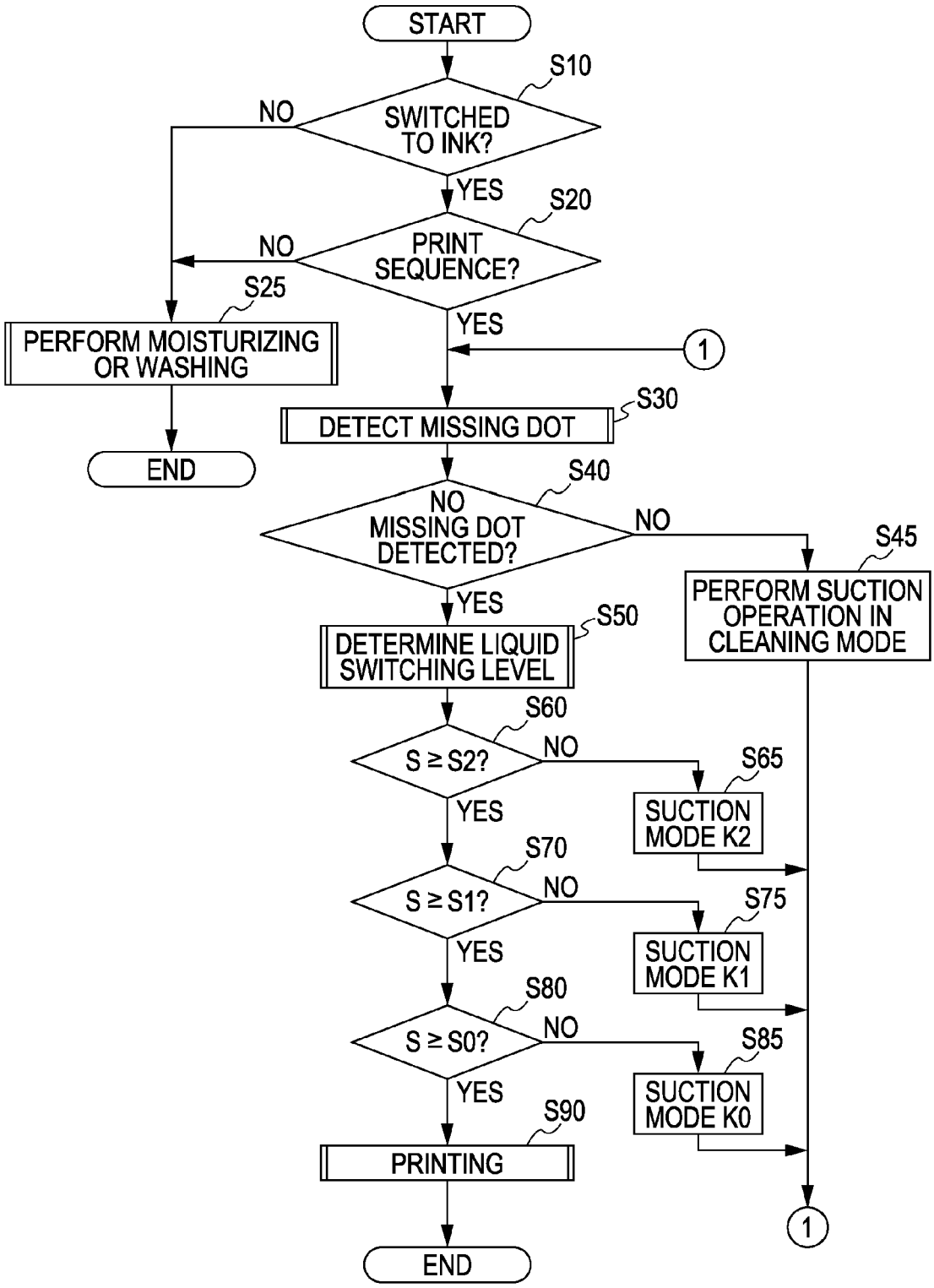
FIG. 8 is a flowchart showing a first example of a liquid switching process.

FIG. 8 is a flowchart showing an example of a switching process operation performed when liquid switching is performed in the ink jet printer main unit 1. The switching valve controller 53 controls the switching unit 16 after the liquid supplied to the recording head 30 is switched. First it is determined S10 whether the switching operation is switching to ink.

The switching operation is deemed to be switching to ink in two situations. First, when switching from ink to ink, and second, when switching from functional liquid such as moisturizing liquid or washing liquid to ink. Conversely, the switching operation is deemed to be switching to non-ink such as a moisturizing liquid or washing liquid, that is, functional liquid in two situations. First, when switching from ink to functional liquid such as moisturizing liquid or washing liquid, and second, when switching between functional liquids, that is, from moisturizing liquid to washing liquid or from washing liquid to moisturizing liquid. The determination of whether the switching operation is identified as switching to ink is specifically performed based on a switching command to the switching valve by the switching valve controller 53.

If it is determined S10 that the switching is not switching to ink ("N" in step S10), then it is determined that the operation is switching to moisturizing liquid or washing liquid and the process proceeds. Next, moisturizing by the moisturizing controller 50 or washing by the washing controller 51 is performed S25, and the process is finished.

In other words, when the liquid supplied to the recording head 30 is switched to functional liquid different from recording ink, a missing dot detecting operation, liquid switching level determination, and suction control are not executed. This is because there will be no involvement of printing and no need for any strict management of missing dots or any strict management of liquid switching levels.

Conversely, when the liquid supplied to the recording head 30 is switched to a recording ink by the switching unit 16, strict management of missing dots and strict management of liquid switching levels is needed. Thus, a missing dot detecting operation, liquid switching level determination, and suction control are executed.

If it is determined ("Y" in S10) that the switching is switching to ink, the process proceeds and it is determined S20 whether a print sequence is the next scheduled sequence By evaluating the a control command scheduled by the print controller 46.

The print sequence occurs when printing based on print data is performed on the recording paper 23 controlled by the driver 45. When the print sequence is not executed, a functional operation, such as a moisturizing sequence controlled by the moisturizing controller 50 or a washing sequence controlled by the washing controller 51, is scheduled to be executed. Depending on circumstances, the moisturizing operation may be performed by using ink instead of the moisturizing liquid, and the washing operation may be performed by using ink instead of the washing liquid.

If it is determined ("N" in step S20) that the sequence scheduled to be next executed is not the print sequence, the process proceeds to the moisturizing S25 by the moisturizing controller 50 or the washing by the washing controller 51, and the process finishes.

Similar to the case previously described, since there is no printing operation, there does not need strict management of missing dots or liquid switching levels. Thus, when the liquid switched to the recording head 30 is switched by the switching unit 16 before a non-printing operation, then the missing dot detecting operation, liquid switching level determination, and suction control are not executed.

Conversely, when the liquid switched to the recording head 30 is switched by the switching unit 16 before the print sequence is executed, strict management of missing dots and strict management of liquid switching levels are needed. Thus, the missing dot detecting operation S30 and the liquid switching level determination S50 and suction control S85 are executed.

Figure 9:
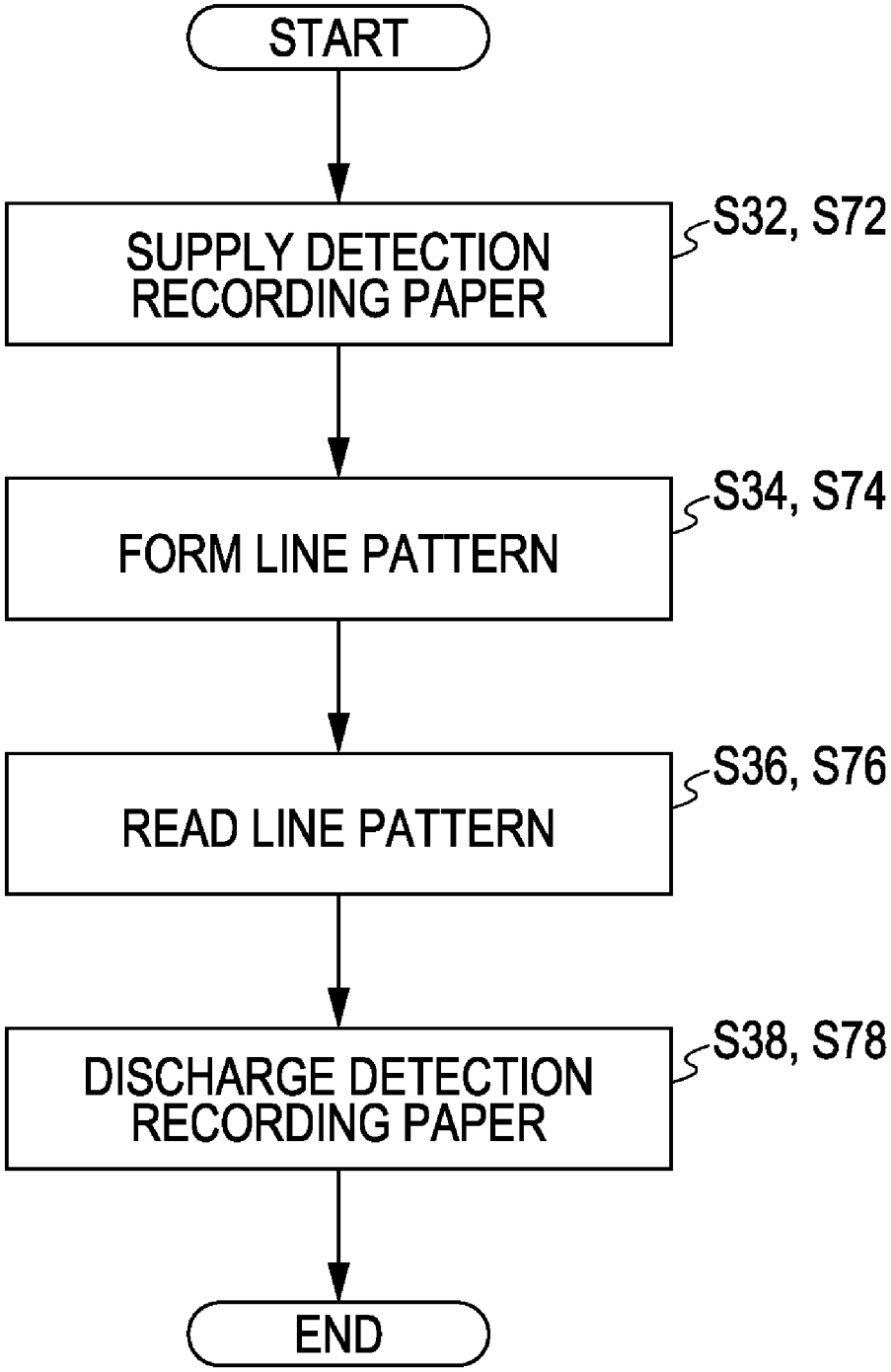
FIG. 9 is a flowchart showing an example of a missing dot detecting process.

If it is determined ("Y" in step S20) that the next scheduled sequence is the print sequence, the process proceeds to the execution S30 of missing dot detection, which is described more fully in reference to FIG. 9.

First the recording paper 23, which is used for detection, is supplied S32 onto a platen. Next, a trial ejection is performed S34 by all the nozzles of the nozzle rows 25*a* to 25*d*, while moving the carriage 3 above the recording paper 23, whereby the straight line patterns 24 are formed on the recording paper 23. Next, any intermittence portions of the line pattern is detected S36 by moving the intermittence detector 22 above the straight line patterns 24 using the paper feed mechanism to repeat the sequential transportation of the recording paper 23 for each pattern by each pattern length. When the detection S36 is finished, the recording paper 23 (used for detection) is discharged S38.

Returning to FIG. 8, during the missing dot detection S30 it is determined whether there is a missing dot or an intermittence portion.

If it is determined (indicated by "N") that the missing detection process has detected S40 any missing dot, then suction operation is performed S45 in the cleaning mode, and recovery operation for recovering from defect in nozzle ejection is executed before the process returns to the missing dot detecting operation S30.

If the missing dot determination indicates ("Y" in S40) that there is no missing dot, then the process proceeds the liquid switching level determination S50. In the liquid switching level determination process, the detector 17 detects characteristic value S of liquid, and a liquid switching level is determined on the depending on whether characteristic value S exceeds a predetermined threshold value. In this example, the threshold value is set to have three levels represented by S0>S1>S2, where the state in which liquid is deemed to be completely be switched is represented by S0. In addition, in the suction mode, the suction level is accordingly set to have three levels represented by K2>K1>K0.

First, it is determined S60 whether characteristic value S is equal to or greater than S2. If characteristic value S is less than S2 ("N" in step S60), the process proceeds to S65. In S65, suction is performed in the strongest suction mode K2 before returning to S30 again, where the missing dot detection is again executed.

If, in S60, the characteristic value S is equal to or greater than S2 ("Y" in step S60), the process proceeds to S70, and it is determined whether the characteristic value S is equal to or greater than S1. If, in S70, characteristic value S is less than S1 ("N" in S70), the process proceeds to S75. In S75, suction is performed in the second suction mode K1 before returning to S30, where the missing dot detection is executed again.

If, in S70, characteristic value S is equal to or greater than S1 ("Y" in S70), the process proceeds to S80 and it is determined whether characteristic value S is equal to or greater than S0. If, in S80, characteristic value S is less than S0 ("N" in S80), the process proceeds to S85. In S85, suction is performed in the third strongest suction mode K0 before returning to S30 again, where the missing dot detection is executed again.

If, in S80, the characteristic value S is equal to or greater than S0 ("Y" in S80), it is indicated that the liquid has been completely switched. Thus, the process proceeds to S90, where the printing is executed, and the finishes when a predetermined print operation is completed.

Figure 10:
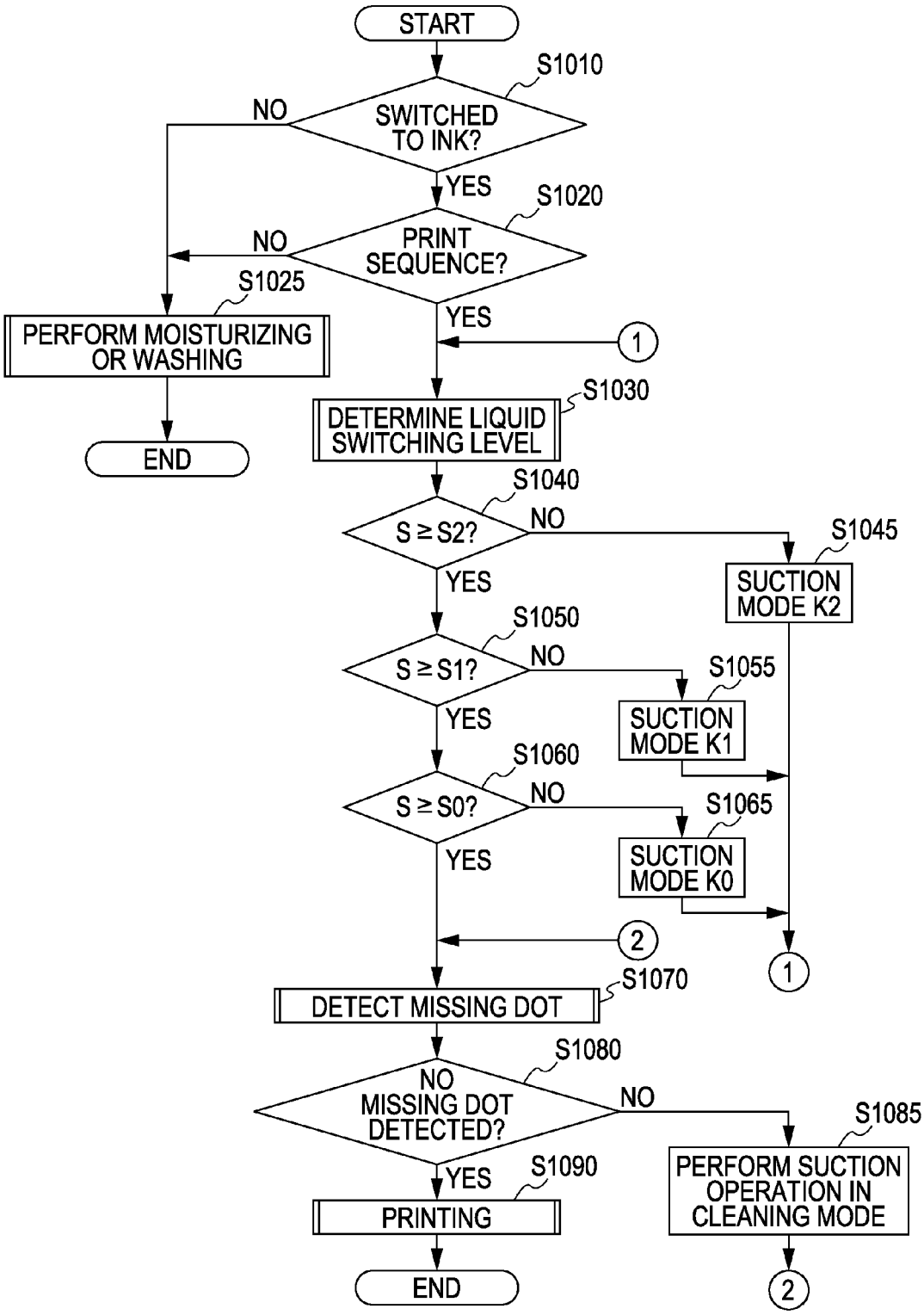
FIG. 10 is a flowchart showing a second example of the liquid switching process.

FIG. 10 is a flowchart showing a second example of the switching process operation performed when the switching unit 16 performs a liquid switching in the ink jet printer main unit 1.

After the liquid supplied to the recording head 30 is switched, by switching valve controller 53 which controls the switching unit 16, it is first determined S1010 whether the switching operation is identified as switching to ink.

The ink switching is divided into two types. One is switching from ink to ink, and the other is switching from functional liquid such as moisturizing liquid or washing liquid to ink. Conversely, switching to non-ink is switching to moisturizing liquid, washing liquid, or other functional liquid.

The switching to non-ink occurs in two situations, switching from ink to functional liquid such as moisturizing liquid or washing liquid, and between functional liquids, that is, from moisturizing liquid to washing liquid or from washing liquid to moisturizing liquid. The determination of whether the switching operation is identified as switching to ink is specifically performed based on a switching command sent to the switching valve by the switching valve controller 53.

If it is determined ("N" in step S10) that the switching is not switching to ink, then it is deemed as having been switched to moisturizing liquid or washing liquid. Thus, the process proceeds to S1025, where moisturizing by the moisturizing controller 50 or washing by the washing controller 51 is executed before the process finishes.

In other words, when the liquid supplied to the recording head 30 is switched to a functional liquid different from a recording ink by the switching unit 16, a missing dot detecting operation S1030, and liquid switching level determination S1050 and the suction control S1085 are not executed. These operations are not necessary because there is no involvement of printing in the use of a non-ink, functional liquid, meaning that there is no need for strict management of liquid switching levels.

Conversely, when the liquid supplied to the recording head 30 is switched by the switching unit 16 to a recording ink, strict management of missing dots and liquid switching levels are needed. Thus, the missing dot detecting operation S1030 and the liquid switching level determination S1050 and suction control S1085 are executed.

If it is determined ("Y" in step S1010) that the switching is identified as switching to ink, the process proceeds to S1020, where it is determined whether a sequence scheduled to be next executed is a print sequence.

The print sequence represents the case where printing performed on the recording paper 23 based on print data controlled by the driver 45. When the print sequence is not executed, the functional operation, such as the moisturizing sequence or the washing sequence, is scheduled to be executed. Depending on circumstances, the moisturizing operation may be performed using ink instead of the moisturizing liquid, and the washing operation may be performed using ink instead of the washing liquid. The determination of whether the next scheduled sequence is the print sequence is performed by the print controller 46 on the basis of a control command schedule.

If it is determined ("N" in S1020) that the next scheduled sequence is not the print sequence, the process proceeds to S1025 where the moisturizing by the moisturizing controller 50 or the washing by the washing controller 51 operation is executed before the process finishes.

In the case where the next scheduled sequence is not the print sequence, there is no need for strict management of missing dots or strict management of liquid switching levels. Thus, when the liquid switched to the recording head 30 is switched by before a non-printing operation is executed, neither the missing dot detecting operation S1030, the liquid switching level determination S1050, or the suction control S1085 need to be executed.

Conversely, when the liquid switched to the recording head 30 is switched before a print sequence is executed, there is a need for strict management of missing dots and liquid switching levels. Thus, the missing dot detecting operation S1030 and the liquid switching level determination S1050 and suction control S1085 are executed.

If it is determined ("Y" in S1020) that the next sequence scheduled is a print sequence, then the process proceeds to 1030 and liquid switching level determination is executed. In the liquid switching level determination 1030, the detector 17 detects characteristic value S of liquid, and a liquid switching level is determined on the based upon whether the characteristic value S exceeds a predetermined threshold value. In this example, the threshold value is set to have three levels represented by S0>S1>S2, and the state in which liquid is deemed to be completely switched is represented by S0. In addition, in the suction mode, the suction level is accordingly set to have three levels represented by K2>K1>K0.

First it is determined S1040 whether the characteristic value S is equal to or greater than S2. If the characteristic value S is less than S2 ("N" in S1040), the process proceeds to S1045. In S1065, suction is performed in the strongest suction mode K2 before returning to S1030 again, where the missing dot detection is executed again.

If, the characteristic value S is equal to or greater than S2 ("Y" in S1040), the process proceeds to S1050, and it is determined whether the characteristic value S is equal to or greater than S1. If, in S1050, the characteristic value S is less than S1 ("N" in S1050), the process proceeds to S1055 where suction is performed in the second strongest suction mode K1 before returning to S1030 again, where the liquid switching level determination is executed again.

If the characteristic value S is equal to or greater than S1 ("Y" in S1050), the process proceeds to S1060 and it is determined whether the characteristic value S is equal to or greater than S0. If the characteristic value S is less than S0 ("N" in S1060), the process proceeds to S1065, where suction is performed in the third strongest suction mode K0 before returning to S30, where the liquid switching level determination is executed again.

If the characteristic value S is equal to or greater than S0 ("Y" in S1060), it is deemed that the liquid has completely be switched and the process proceeds to missing dot detection 1070, as previously described in reference to FIG. 9.

Next, it is determined S1070 whether the missing detection operation has detected a missing dot or an intermittence portion. If it is determined (indicated by "N") that the missing detection has detected a missing dot, then the process proceeds to S1085 where the suction operation is performed in cleaning mode and the recovery operation for recovering from defect in nozzle ejection is executed before the process returns to the missing dot detecting operation in S1070.

If no missing dot is detected ("Y" in S1080), the process proceeds, printing is executed S1090, and the process finishes when a predetermined print operation is completed.

According to the switching in this embodiment, after switching liquid using the switching unit 16, both liquid switching level determination and suction control are performed before the print sequence, and missing dot detection and recovery from defect in nozzle ejection are performed after liquid switching is deemed to be completed. Thus, both the liquid switching level determination and the suction control, each which require relatively large liquid suction, are first performed, and the missing dot detection and recovery from a defect in nozzle ejection are performed after liquid switching is completed. This method helps to ensure that the liquids have successfully switched while preventing unnecessary liquid consumption.

Another aspect of the invention is that when a liquid supplied to the recording head 30 is switched to a different liquid, a characteristic of the different liquid is detected. The level of the switching of the different liquid is determined based on the result of the detection, as is suction by the suction pump 11. Thus, liquid ejection to the recording paper 23 can be initiated after confirming that the liquid in the recording head 30 has substantially completely been switched. This makes it possible to ensure initial ejection quality after liquid switching.

Additionally, in order to detect a characteristic of a liquid in a supply flow path for supplying liquid to the recording head 30, the detector 17 performs liquid switching level determination by performing liquid characteristic detection in a supply flow path at a position located before liquid is supplied to the recording head 30. Thus, liquid ejection to the recording paper 23 can be initiated after confirming that the liquid in the recording head 30 has been switched. This makes it possible to ensure initial ejection quality after liquid switching.

The above embodiment includes a plurality of cartridges 2*a* to 2*j* for supplying liquids to the recording head 30 together with a switching unit 16 for switching liquids supplied to the recording head 30 by selecting an arbitrary number of cartridges from among the plurality of cartridges 2*a* to 2*j*. The controller executes a liquid switching level determination and suction control when the liquid supplied to the recording head 30 is switched by the switching unit 16. Thus, by executing a liquid switching level determination and suction control depending on liquid switching by the switching unit 16, initial ejection quality after liquid switching can be ensured.

In order to execute a liquid switching level determination and suction control when the liquid supplied to the recording head 30 is switched by the switching unit 16, the controller executes a liquid switching level determination and suction control operation before the liquid is switched to a recording ink and printing is performed with the recording ink. This makes it possible to ensure initial ejection quality after liquid switching.

When the liquid supplied to the recording head 30 is switched to a functional liquid different from ink by the switching unit 16, the controller executes no liquid switching level determination and no suction control, because print quality is not evaluated after the liquid is switched to the functional liquid different from an ink. Therefore, apparatus throughput can be improved and unnecessary liquid consumption can be prevented.

In order to execute a liquid switching level determination and suction control when the liquid supplied to the recording head 30 is switched by the switching unit 16 and a printing operation is scheduled, the controller executes liquid switching level determination and suction control before printing is performed with ink. Thus, initial ejection quality after liquid switching can be ensured.

After the liquid supplied to the recording head 30 is switched by the switching unit 16 and the scheduled functional operation different is than printing or recording to the recording paper 23, the controller executes no liquid switching level determination or suction control. Thus, the controller executes no liquid switching level determination and no suction when print quality is not evaluated. Therefore, apparatus throughput can be improved and unnecessary liquid consumption can be prevented.

When the liquid supplied to the recording head 30 is switched by the switching unit 16, in order to execute a missing dot detecting operation for detecting a nozzle defective in ejection by performing trial ejection of all the nozzles, and to execute a nozzle recovery operation when a nozzle defective in ejection is detected, the controller ensures that the defective nozzle is recovered. Thus, initial ejection quality after liquid switching can be ensured.

In order to execute the missing dot detecting operation when the liquid supplied to the recording head 30 is switched to a recording ink, the controller recovers the defective nozzle before the liquid is switched to the recording ink and printing is performed with the recording ink. Thus, initial ejection quality after liquid switching can be ensured.

Since the controller executes no missing dot detecting operation when the liquid supplied to the recording head 30 is switched to a functional liquid different from an ink, the controller performs no recovery on a defective nozzle when print quality is not evaluated. Thus, apparatus throughput can be improved and unnecessary liquid consumption can be prevented.

In order to execute the missing dot detecting operation when the printing operation is the next scheduled operation, the liquid supplied to the recording head 30 is switched by the switching unit 16 and the controller performs recovery on a defective printing is performed with ink. Thus, initial ejection quality after liquid switching can be ensured.

Since the controller does not execute the missing dot detecting operation after the liquid supplied to the recording head 30 is switched by the switching unit 16 and the next scheduled functional operation is not a printing operation, the controller does not perform recovery on a defective nozzle since print quality is not then evaluated. Thus, apparatus throughput can be improved and unnecessary liquid consumption can be prevented.

In a liquid switching level determination, the controller sets a characteristic value threshold value of a liquid detected by the detector 17 to have a plurality of levels and controls the operation so that suction is performed in a plurality of levels based on the levels of the threshold value. Thus, it is ensured that liquid switching is completed while preventing liquid consumption caused by unnecessary suction.

Figure 11A:
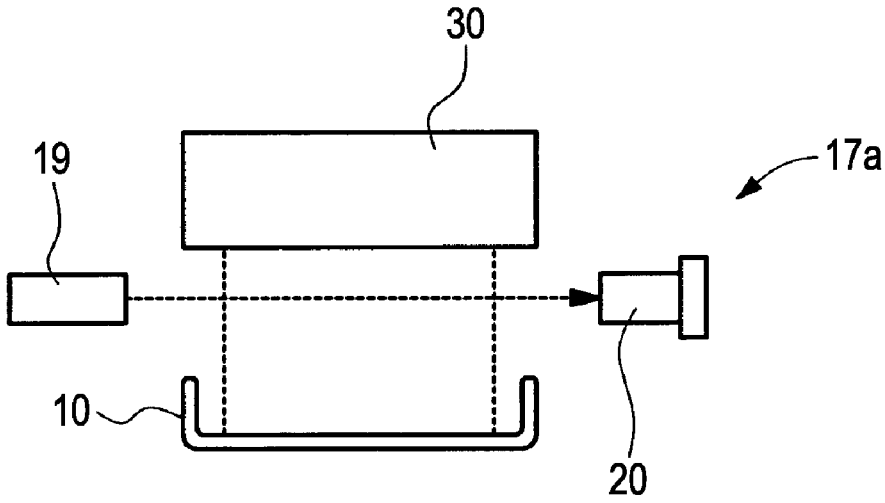
FIGS. 11A and 11B are illustrations of a detector in a second embodiment of the invention.
Figure 11B:
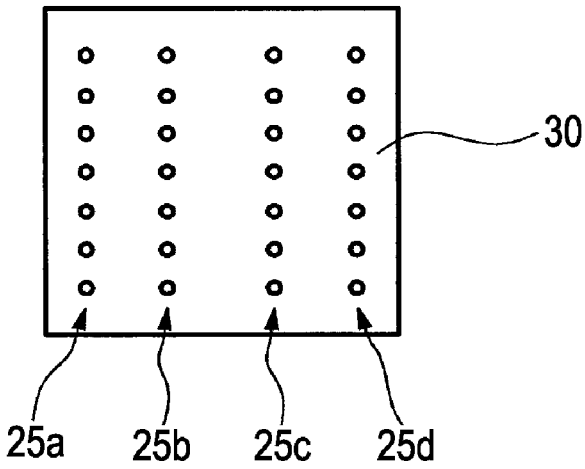
Figure 12:
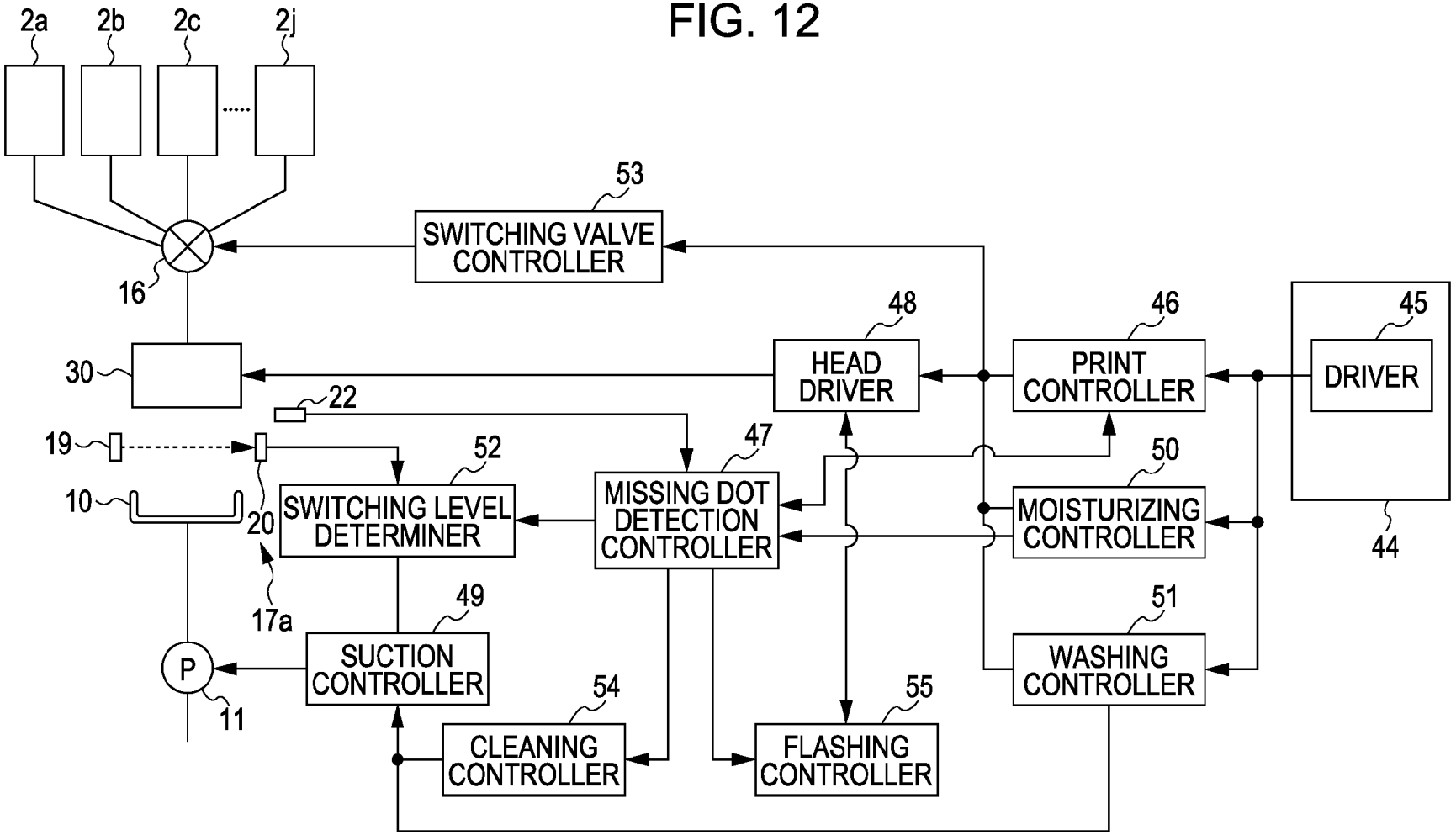
FIG. 12 is a block diagram of a system configuration in the second embodiment.

FIGS. 11A, 11B, and 12 show a second embodiment of the invention. In this embodiment, instead of detecting a characteristic of the liquid in a supply flow path, the detector 17 can detect a characteristic of the liquid ejected in a flashing manner from the recording head 30. The detector 17 directly detects characteristics of liquids ejected from outermost nozzle rows 25*a* and 25*d* among a plurality of nozzle rows 25*a* to 25*d* provided on the recording head 30. The other points are similar to those in the above-described first embodiment. Similar portions are denoted by identical reference numerals.

In this embodiment, when each liquid supplied to the recording head 30 is switched, a characteristic of the liquid ejected from the recording head 30 is detected, and a liquid switching level is determined from the result of the detection. Depending on the result of the determination, suction of the suction pump 11 is controlled. Thus, the substantially completion of the liquid in the recording head 30 is confirmed before the liquid ejection to the recording paper 23 can be initiated, which ensures initial ejection quality after liquid switching.

The detector 17 detects characteristics of liquids ejected from outermost nozzle rows 25*a* and 25*d* among the nozzle rows 25*a* to 25*d* provided on the recording head 30. Flow paths of the outermost nozzle rows 25*a* and 25*d* in the recording head 30 are longer than those of the nozzle rows 25*b* and 25*c*, which are located towards the center. Accordingly, since the outer nozzles correspond the flow paths 25*a* and 25*d*, characteristics of liquids ejected from the flow paths 25*a* and 25*d* are more likely to contain residual liquid, and are thus used to perform the liquid switching level determination. Therefore, the liquid ejection operation on the recording paper 23 can be initiated after confirming that the liquid in the recording head 30 has been switched. This makes it possible to ensure initial ejection quality after liquid switching.

The detector 17 may directly detect characteristics of liquids ejected from outermost nozzles among the nozzle rows 25*a* to 25*d* provided on the recording head 30. Since, it is relatively more difficult for liquid to flow in the nozzles located at an outermost position the recording head 30 compared with nozzles in the vicinity of the center, any unswitched liquid is more likely to remain in the outermost nozzle, and the characteristic of a liquid ejected from the outermost nozzle is appropriate for performing the liquid switching level determination. Thus, liquid ejection to the recording paper 23 can be initiated after confirming that the liquid in the recording head 30 has been switched. This makes it possible to ensure initial ejection quality after liquid switching. The other portions produce operation and advantages similar to those in the first embodiment.

Figure 13:
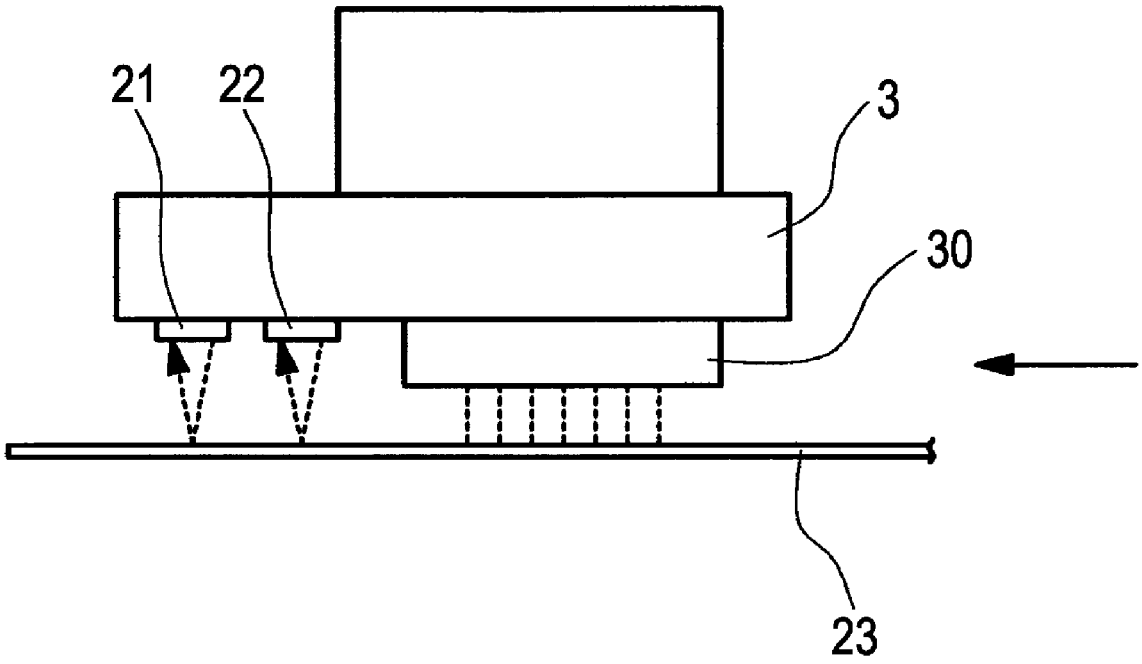
FIG. 13 is an illustration of a specific example of a detector in a third embodiment of the invention.
Figure 14:
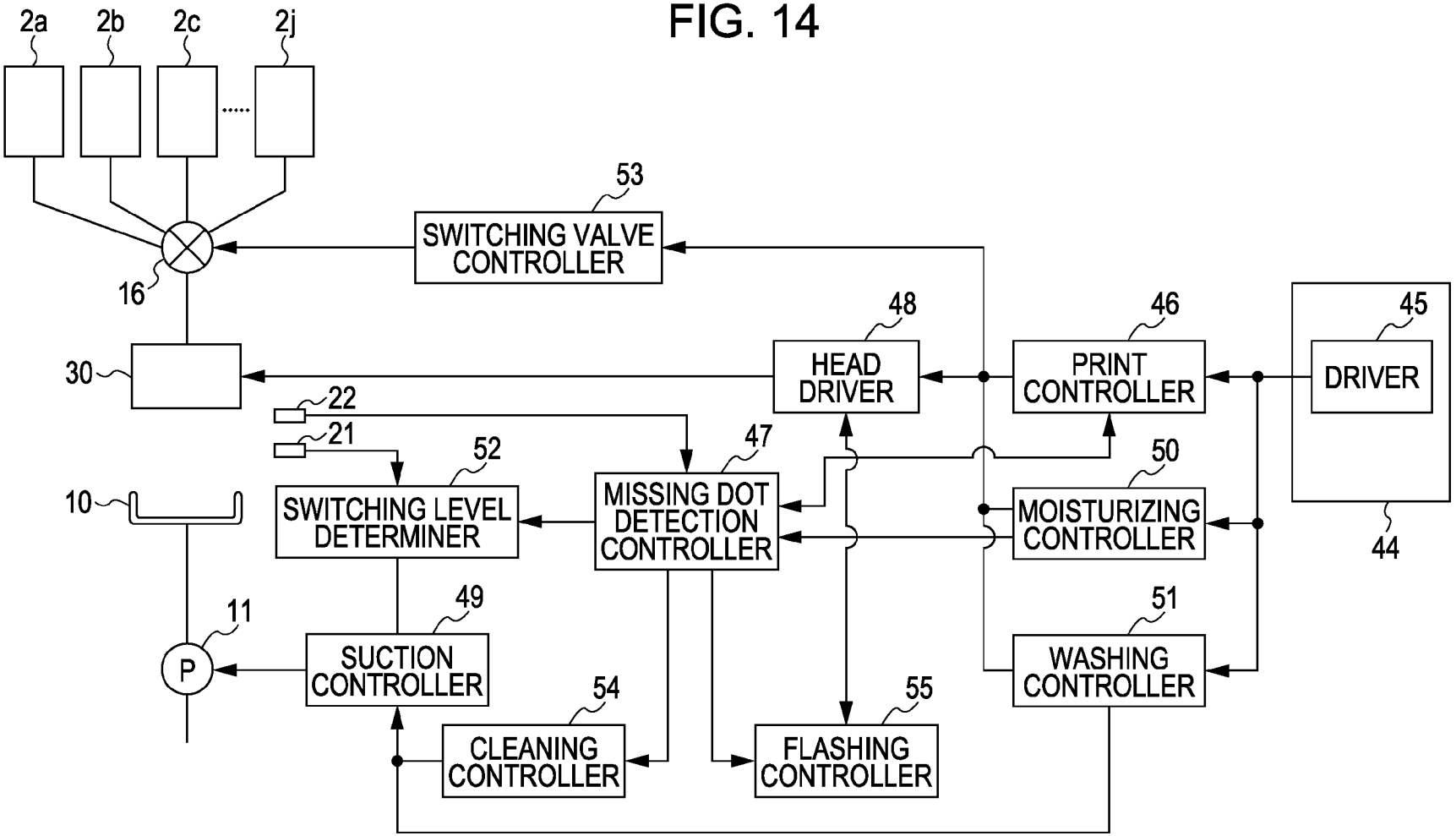
FIG. 14 is a functional block diagram showing a system configuration in the third embodiment.

FIGS. 13 and 14 show a third embodiment of the invention.

In the third embodiment, instead of detecting a characteristic of a liquid in the supply flow path 18, by using a color CCD sensor 21 used for detecting characteristics of straight line patterns 24, or marks formed such when the liquid ejected from the recording head 30 reaches the recording paper 23, the detector 17 directly detects color characteristics of actually printed straight line patterns 24. The operation of forming the straight line patterns 24 is similar to the missing dot detecting operation. The other points are similar to those in the first and second embodiments. Similar portions are denoted by identical reference numerals.

In the third embodiment, the time when the liquid in the recording head 30 is deemed to be switched is determined from a characteristic of the liquid ejected from the recording head 30 compared to a switching level. Based on this determination, the strength of suction in the suction pump 11 is controlled. Thus, the substantial completion of the switch of the liquid in the recording head 30 is confirmed before liquid ejection to the recording paper 23 can be initiated, ensuring the quality of the initial ejection following the switch.

In order to detect a characteristic of a mark formed when liquid is ejected from the recording head 30 and reaches the recording paper 23, a liquid switching level determination is made by detecting a characteristic of the mark. Then, after confirming that the liquid in the recording head 30 has been switched to such a level that an actual mark formed by ejection has no problem, liquid ejection to the recording paper 23 can be initiated, thus ensuring the quality of the initial ejection following the switch. The other portions produce of the third embodiment contain operation and advantages similar to those in the first and second embodiments.

In each of the above-described embodiments, the recovering operation for a defective nozzle detected during the missing dot detection is performed by suction in the cleaning mode. However, the recovering operation is not limited thereto and the recovery operation may be performed by ejection during a flashing operation.

In each of the above-described embodiments, the functional liquids have been described as a moisturizing liquid and a washing liquid. However, the functional liquids are not limited to these liquids and various types of functional inks other than printing inks can be used.

In each of the above-described embodiments, the inks have been described as a dye ink or a pigment ink. However, the ink types are not limited thereto and other types of inks can be switched for use.

In each of the above-described embodiments, the recording head 30 is described as a liquid ejecting apparatus in which a piezoelectric vibrator is used as a pressure generating element that is a driving element for ejecting a liquid as well as an apparatus where a heat generating element is used.

Additionally, the liquid switching operation can be in the form of a program to be executed by a computer apparatus, with the program recorded on a recording medium, and via a communication network.

Typical examples of the liquid ejecting apparatus include an ink jet recording apparatus including an image-recording ink jet recording head as described above. The present invention is applicable to various types of liquid ejecting apparatuses such apparatuses used in the production of color filters for liquid crystal displays. In such configurations, the apparatus includes a color material ejecting head. In another apparatus suitable for use in accordance with the embodiments of the present invention is an apparatus used for forming electrodes of organic electroluminescence displays and field emission displays; the apparatus including an electrode material (conductive paste) ejecting head. In another configuration suitable for use with the present invention, an apparatus is used in biochip production, the apparatus including a bioorganic substance ejecting head. Finally, the invention may be used in an apparatus used as a precision pipette.

What is claimed is:

1. A liquid ejecting apparatus comprising:

an ejecting head that ejects a liquid from at least one row of nozzles to an object;

a capping unit that caps a nozzle-formed surface of the ejecting head;

a suction unit that suctions a space in the capping unit;

a detector disposed in a liquid supply path that supplies liquid to the ejecting head that detects the liquid in the liquid supply path in order to detect a color characteristic of a different liquid when the liquid supplied to the ejecting head is switched to the different liquid; and a controller that performs a determination of a liquid switching level based on the detection by the detector and controls an amount of suction by the suction unit depending on a result of the determination.

2. The liquid ejecting apparatus according to claim 1, wherein the detector detects a characteristic of a liquid in a supply flow path of the liquid ejecting apparatus in which the liquid supplied to the ejecting head flows.

3. The liquid ejecting apparatus according to claim 1, wherein the detector detects a characteristic of a liquid ejected from an outermost row of nozzles among the rows of nozzles of the ejecting head.

4. The liquid ejecting apparatus according to claim 1, wherein the detector detects a characteristic of a liquid from an outermost nozzle in each row of nozzles of the ejecting head.

5. The liquid ejecting apparatus according to claim 1, wherein the detector detects a characteristic of a mark formed such that the liquid ejected by the ejecting head reaches the object.

6. The liquid ejecting apparatus according to claim 1, further comprising:

a plurality of liquid supply units that supply liquids to the ejecting head; and a switching unit that switches each liquid supplied to the ejecting head by selecting a predetermined liquid supply unit from among the plurality of liquid supply units, wherein the controller executes determination of a switching level of the liquid and control of suction when the liquid supplied to the ejecting head is switched by the switching unit.

7. The liquid ejecting apparatus according to claim 6, wherein the controller executes the determination of the switching level of the liquid and the control of suction when the liquid supplied to the ejecting head is switched to a recording ink by the switching unit.

8. The liquid ejecting apparatus according to claim 6, wherein the controller executes no determination of the switching level of the liquid and no control of suction, when the liquid supplied to the ejecting head is switched to a functional liquid different from the recording ink by the switching unit.

9. The liquid ejecting apparatus according to claim 6, wherein the control unit executes the determination of the switching level of the liquid and the control of suction, when an operation of recording to the object is executed after the liquid supplied to the ejecting head is switched by the switching unit.

10. The liquid ejecting apparatus according to claim 6, wherein the control unit executes no determination of the switching level of the liquid and no control of suction when a functional operation different from an operation of recording to the object is executed after the liquid supplied to the ejecting head is switched by the switching unit.

11. The liquid ejecting apparatus according to claim 6, wherein the control unit executes a defective ejection detecting operation for detecting a nozzle defective in ejection by performing trial ejection from all the nozzles and executes a nozzle recovery operation when a nozzle defective in ejection is detected.

12. The liquid ejecting apparatus according to claim 11, wherein the control unit executes the defective ejection detecting operation when the liquid supplied to the ejecting head is switched to a recording ink by the switching unit.

13. The liquid ejecting apparatus according to claim 11, wherein the control unit executes no defective ejection detecting operation when the liquid supplied to the ejecting head is switched to a functional liquid different from a recording ink by the switching unit.

14. The liquid ejecting apparatus according to claim 11, wherein the control unit executes the defective ejection detecting operation when an operation of recording to the object is executed after the liquid supplied to the ejecting head is switched by the switching unit.

15. The liquid ejecting apparatus according to claim 11, wherein the control unit executes no defective ejection detecting operation when a functional operation different from an operation of recording to the object is executed after the liquid supplied to the ejecting head is switched by the switching unit.

16. The liquid ejecting apparatus according to claim 1, wherein the determination of the liquid switching level for a characteristic value of the liquid detected by the detector includes a plurality of threshold levels set by the control unit, and the control unit controls suction to be performed in a plurality of suction mode levels depending on the plurality of threshold levels.

17. The liquid ejecting apparatus according to claim 1, wherein the control unit executes a defective ejection detecting operation for detecting a nozzle defective in ejection by performing trial ejection from all the nozzles before an operation of recording to the object is executed and after switching of the supplied liquid and the determination of the liquid switching level and the control of suction are executed.

18. A liquid ejecting apparatus comprising:

an ejecting head that ejects a liquid from at least one row of nozzles to an object;

a capping unit that caps a nozzle-formed surface of the ejecting head;

a suction unit that suctions a space in the capping unit;

a plurality of liquid supply units that supply liquids to the ejecting head; and a switching unit that switches each liquid supplied to the ejecting head by selecting a predetermined liquid supply unit from among the plurality of liquid supply units, a detector disposed in a liquid supply path that supplies liquid to the electing head that detects the liquid in the liquid supply path in order to detect a color characteristic of a different liquid when the liquid supplied to the ejecting head is switched to the different liquid; and a controller that performs a determination of a liquid switching level based on the detection by the detector when the liquid supplied to the ejecting head is switched by the switching unit, and controls an amount of suction by the suction unit by setting a plurality of threshold values relating to the characteristic value of the liquid and applying suction mode values depending on the plurality of threshold values.

19. The liquid ejecting apparatus according to claim 18, wherein the detector detects a characteristic of a liquid in a supply flow path of the liquid ejecting apparatus in which the liquid supplied to the ejecting head flows.

20. The liquid ejecting apparatus according to claim 18, wherein the detector detects a characteristic of a liquid ejected from an outermost row of nozzles among the rows of nozzles of the ejecting head.

21. The liquid ejecting apparatus according to claim 18, wherein the detector detects a characteristic of a liquid from an outermost nozzle in each row of nozzles of the ejecting head.

22. The liquid ejecting apparatus according to claim 18, wherein the detector detects a characteristic of a mark formed such that the liquid ejected by the ejecting head reaches the object.

23. A detector disposed in a liquid supply path that supplies liquid to the ejecting head that detects the liquid in the liquid supply path in order to detect a color characteristic of the liquid ejected by the ejecting head when the liquid supplied to the ejecting head is switched to a different liquid; and a controller that performs a determination of a liquid switching level based on the detection by the detector and controls an amount of suction by the suction unit depending on a result of the determination.

* * * * *